US009101517B2

(12) United States Patent
Simmonds et al.

(10) Patent No.: US 9,101,517 B2
(45) Date of Patent: Aug. 11, 2015

(54) PATIENT-SUPPORT APPARATUS WITH A CONFIGURABLE SIDERAIL

(75) Inventors: Scott M. Simmonds, Greensburg, IN (US); Joseph A. Kummer, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 241 days.

(21) Appl. No.: 12/871,014

(22) Filed: Aug. 30, 2010

(65) Prior Publication Data

US 2012/0047654 A1 Mar. 1, 2012

(51) Int. Cl.
*A61G 7/05* (2006.01)

(52) U.S. Cl.
CPC ..... *A61G 7/0507* (2013.01); *A61G 2007/0509* (2013.01); *A61G 2007/0516* (2013.01); *A61G 2007/0521* (2013.01); *Y10T 29/49826* (2015.01)

(58) Field of Classification Search
CPC ..... A61G 7/0507; A61G 2007/0508; A61G 2007/0509
USPC ..... 5/430, 428, 425
See application file for complete search history.

(56) References Cited

U.S. PATENT DOCUMENTS

| | | | |
|---|---|---|---|
| 421,656 | A | 2/1890 | Blanken |
| 993,119 | A | 5/1911 | Stannard |
| 2,136,088 | A | 11/1938 | Stevens |
| 2,644,173 | A | 7/1953 | James |
| 2,710,976 | A | 6/1955 | Martensen |
| 2,951,252 | A | 9/1960 | Roche |
| 2,979,738 | A | 4/1961 | Goldberg |
| 3,018,492 | A | 1/1962 | Rosen |
| 3,148,387 | A | 9/1964 | Sarnie, Jr. et al. |
| 3,195,151 | A | 7/1965 | Boyer |
| 3,220,022 | A | 11/1965 | Nelson |
| 3,262,133 | A | 7/1966 | Beitzel |
| 3,321,779 | A | 5/1967 | Kaufman et al. |
| 3,384,147 | A | 5/1968 | Smith |
| 3,614,795 | A | 10/1971 | Agnew |
| 3,619,824 | A | 11/1971 | Doyle |
| 3,742,530 | A | 7/1973 | Clark |
| 3,877,090 | A | 4/1975 | Schutz |
| 4,183,015 | A | 1/1980 | Drew et al. |
| 4,214,326 | A | 7/1980 | Spann |
| 4,215,446 | A | 8/1980 | Mahoney |
| 4,232,415 | A | 11/1980 | Webber |
| 4,370,765 | A | 2/1983 | Webber |

(Continued)

FOREIGN PATENT DOCUMENTS

| | | |
|---|---|---|
| FR | 2680955 | 3/1993 |
| GB | 2284147 | 5/1995 |

(Continued)

*Primary Examiner* — Robert G Santos
*Assistant Examiner* — Ifeolu Adeboyejo
(74) *Attorney, Agent, or Firm* — Jason Penninger

(57) ABSTRACT

A siderail assembly for a patient-support apparatus including a frame and defining a head end, a foot end longitudinally spaced-apart therefrom, and two laterally spaced-apart sides, comprises a siderail body and a movement assembly. The movement assembly is coupled to the siderail body and is configured to be coupled with the frame of the patient-support apparatus. The movement assembly is configured so that the siderail body moves relative to the frame about a generally laterally-extending axis between a lowered position, a first raised position, and a second raised position laterally spaced apart from the first raised position.

29 Claims, 15 Drawing Sheets

(56) References Cited

U.S. PATENT DOCUMENTS

| | | | | | |
|---|---|---|---|---|---|
| 4,409,695 | A | | 10/1983 | Johnston et al. | |
| 4,439,880 | A | | 4/1984 | Koncelik et al. | |
| D276,112 | S | | 10/1984 | Ferrell et al. | |
| 4,607,402 | A | | 8/1986 | Pollard | |
| 4,653,129 | A | | 3/1987 | Kuck et al. | |
| 4,654,903 | A | | 4/1987 | Chubb et al. | |
| 4,670,923 | A | | 6/1987 | Gabriel et al. | |
| 4,672,698 | A | | 6/1987 | Sands | |
| 4,676,687 | A | | 6/1987 | Koffler | |
| 4,704,750 | A | | 11/1987 | Wheelock | |
| 4,710,049 | A | | 12/1987 | Chang | |
| 4,710,992 | A | | 12/1987 | Falwell et al. | |
| 4,745,647 | A | | 5/1988 | Goodwin | |
| 4,767,419 | A | | 8/1988 | Fattore | |
| 4,768,249 | A | | 9/1988 | Goodwin | |
| 4,783,864 | A | | 11/1988 | Turner | |
| 4,800,600 | A | | 1/1989 | Baum | |
| 4,811,436 | A | * | 3/1989 | Schwartz | 5/93.1 |
| 4,827,545 | A | | 5/1989 | Arp | |
| 4,872,228 | A | | 10/1989 | Bishop | |
| 4,873,734 | A | | 10/1989 | Pollard | |
| 5,010,611 | A | | 4/1991 | Mallett | |
| 5,035,014 | A | | 7/1991 | Blanchard | |
| 5,044,025 | A | | 9/1991 | Hunsinger et al. | |
| 5,077,843 | A | | 1/1992 | Dale et al. | |
| 5,083,332 | A | | 1/1992 | Foster et al. | |
| 5,083,334 | A | | 1/1992 | Huck et al. | |
| 5,084,925 | A | | 2/1992 | Cook | |
| 5,097,550 | A | | 3/1992 | Marra, Jr. | |
| 5,129,117 | A | | 7/1992 | Celestina et al. | |
| 5,175,897 | A | | 1/1993 | Marra, Jr. | |
| 5,179,774 | A | | 1/1993 | Massie | |
| 5,191,663 | A | | 3/1993 | Holder et al. | |
| 5,216,768 | A | | 6/1993 | Bodine et al. | |
| 5,381,571 | A | | 1/1995 | Gabhart | |
| 5,410,765 | A | | 5/1995 | Youngblood | |
| 5,421,046 | A | | 6/1995 | Vande Streek | |
| 5,450,641 | A | | 9/1995 | Montgomery | |
| 5,455,973 | A | | 10/1995 | Brumfield et al. | |
| 5,481,772 | A | | 1/1996 | Glynn et al. | |
| 5,485,699 | A | | 1/1996 | Gabhart | |
| 5,524,306 | A | | 6/1996 | George | |
| 5,535,457 | A | * | 7/1996 | Welsh et al. | 5/93.1 |
| 5,557,817 | A | | 9/1996 | Haddock | |
| 5,577,277 | A | | 11/1996 | Sundberg et al. | |
| 5,628,078 | A | | 5/1997 | Pennington et al. | |
| 5,642,545 | A | | 7/1997 | Howard | |
| 5,671,490 | A | | 9/1997 | Wu | |
| 5,689,839 | A | | 11/1997 | Laganiere et al. | |
| 5,729,849 | A | | 3/1998 | Garakani | |
| 5,732,423 | A | | 3/1998 | Weismiller et al. | |
| 5,749,112 | A | | 5/1998 | Metzler | |
| 5,761,756 | A | | 6/1998 | Nowak | |
| 5,771,506 | A | | 6/1998 | Joiner | |
| 5,781,945 | A | | 7/1998 | Scherer et al. | |
| 5,802,636 | A | | 9/1998 | Corbin et al. | |
| 5,864,900 | A | | 2/1999 | Landau | |
| 5,920,930 | A | * | 7/1999 | Harrow | 5/201 |
| 5,926,873 | A | | 7/1999 | Fountain | |
| 6,058,531 | A | | 5/2000 | Carroll | |
| 6,212,714 | B1 | | 4/2001 | Allen et al. | |
| 6,357,065 | B1 | | 3/2002 | Adams | |
| 6,401,277 | B1 | | 6/2002 | Savage et al. | |
| 7,000,272 | B2 | * | 2/2006 | Allen et al. | 5/624 |
| 7,107,637 | B2 | | 9/2006 | Kuek et al. | |
| 7,222,377 | B2 | | 5/2007 | Kramer et al. | |
| 7,237,284 | B2 | | 7/2007 | Hensley et al. | |
| 7,237,288 | B2 | | 7/2007 | Lemire et al. | |
| 7,350,248 | B2 | | 4/2008 | Hensley et al. | |
| 7,568,244 | B1 | * | 8/2009 | Shamie et al. | 5/100 |
| 7,644,457 | B2 | | 1/2010 | Hensley et al. | |
| 7,676,862 | B2 | | 3/2010 | Poulos et al. | |
| 7,712,165 | B2 | | 5/2010 | Guguin | |
| 7,712,167 | B2 | | 5/2010 | Guguin | |
| 7,793,369 | B2 | | 9/2010 | Guguin et al. | |
| 2006/0021142 | A1 | | 2/2006 | Hornbach et al. | |
| 2006/0026762 | A1 | | 2/2006 | Hornbach et al. | |
| 2006/0277683 | A1 | * | 12/2006 | Lamire et al. | 5/600 |
| 2007/0163043 | A1 | | 7/2007 | Lemire et al. | |
| 2007/0169268 | A1 | * | 7/2007 | Lemire et al. | 5/617 |
| 2007/0174964 | A1 | | 8/2007 | Lemire et al. | |
| 2007/0174965 | A1 | | 8/2007 | Lemire et al. | |
| 2008/0000028 | A1 | | 1/2008 | Lemire et al. | |
| 2009/0013465 | A1 | * | 1/2009 | Guguin | 5/428 |
| 2009/0139028 | A1 | * | 6/2009 | Morin et al. | 5/430 |
| 2009/0229051 | A1 | * | 9/2009 | Heimbrock et al. | 5/430 |

FOREIGN PATENT DOCUMENTS

| | | | |
|---|---|---|---|
| WO | 9428848 | A1 | 12/1994 |
| WO | 2004100724 | A2 | 11/2004 |

* cited by examiner 150
164
156
158
154
116
160
152
158
SD1
16
24
24
16

164
156
162
116
160
154
152
158
FR1
FR2

116
164
156
162
160
154
152
158
SR2

PATIENT-SUPPORT APPARATUS WITH A CONFIGURABLE SIDERAIL

BACKGROUND

The present disclosure is related to patient-support apparatuses. More specifically, the present disclosure is related to a person-support apparatus with siderails movably coupled thereto.

A patient-support apparatus can include a frame with siderails coupled thereto. The siderails can be configured to, for example, locate the edge of the person-support apparatus and/or assist with ingress/egress to/from the person-support apparatus. The siderails can be moveable between a first position or deployed position and a second position or storage position with respect to the frame. While various person-support apparatuses have been developed, there is still room for improvement. Thus a need persists for further contributions in this area of technology.

SUMMARY

The present disclosure includes one or more of the features recited in the appended claims and/or the following features which, alone or in any combination, may comprise patentable subject matter.

In one illustrative embodiment, the siderail configured to move between a storage position and a first deployed position where the siderail body is a first lateral distance from the upper frame and a second deployed position where the siderail body is a second lateral distance from the upper frame.

Additional features alone or in combination with any other feature(s), including those listed above and those listed in the claims and those described in detail below, can comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

Referring now to the illustrative examples in the drawings, wherein like numerals represent the same or similar elements throughout.

DETAILED DESCRIPTION OF THE DRAWINGS

Figure 1:
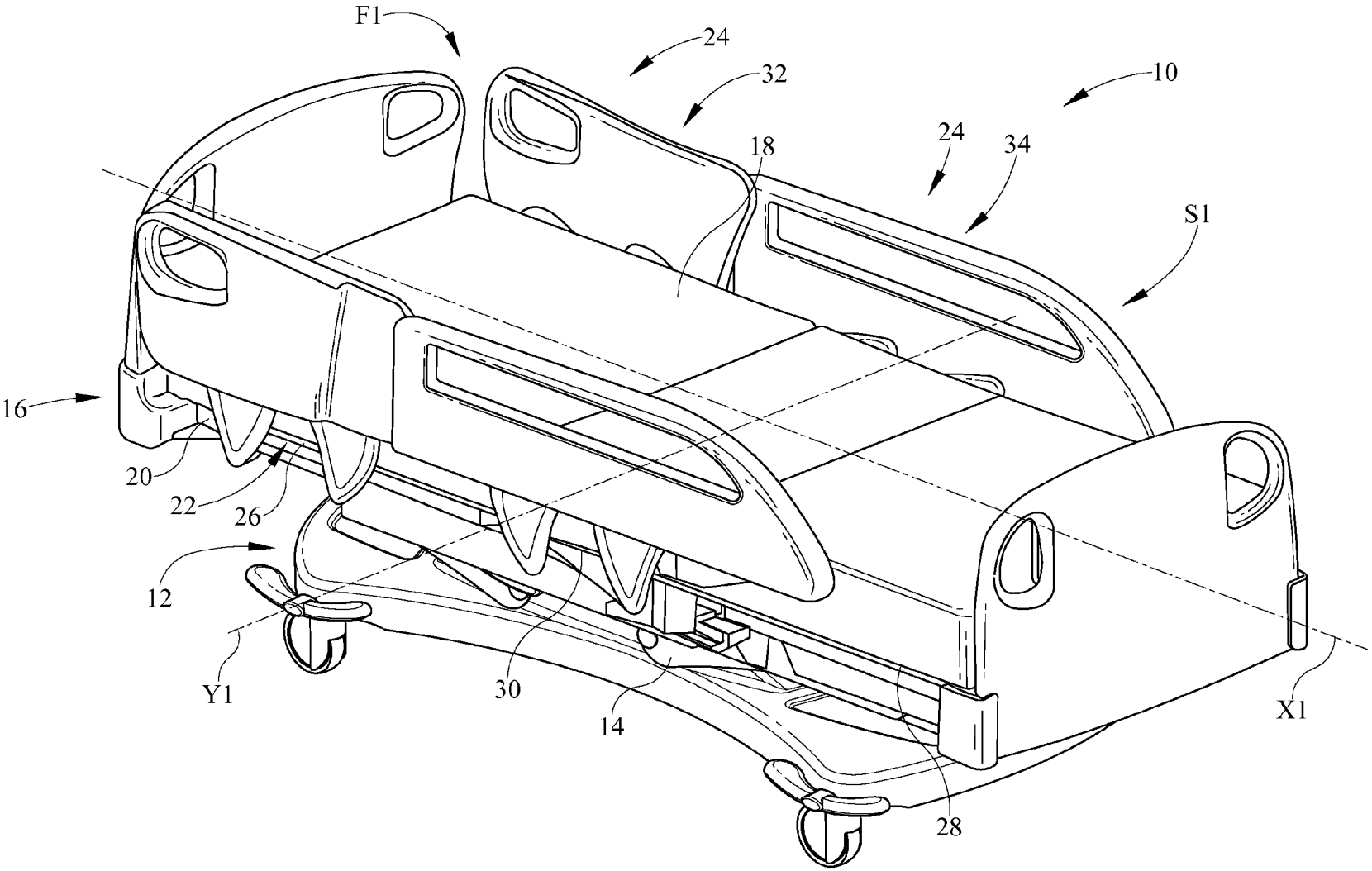
FIG. 1 is a perspective view of a patient-support apparatus with a siderail coupled thereto according to one illustrative embodiment of the current disclosure.
Figure 2:
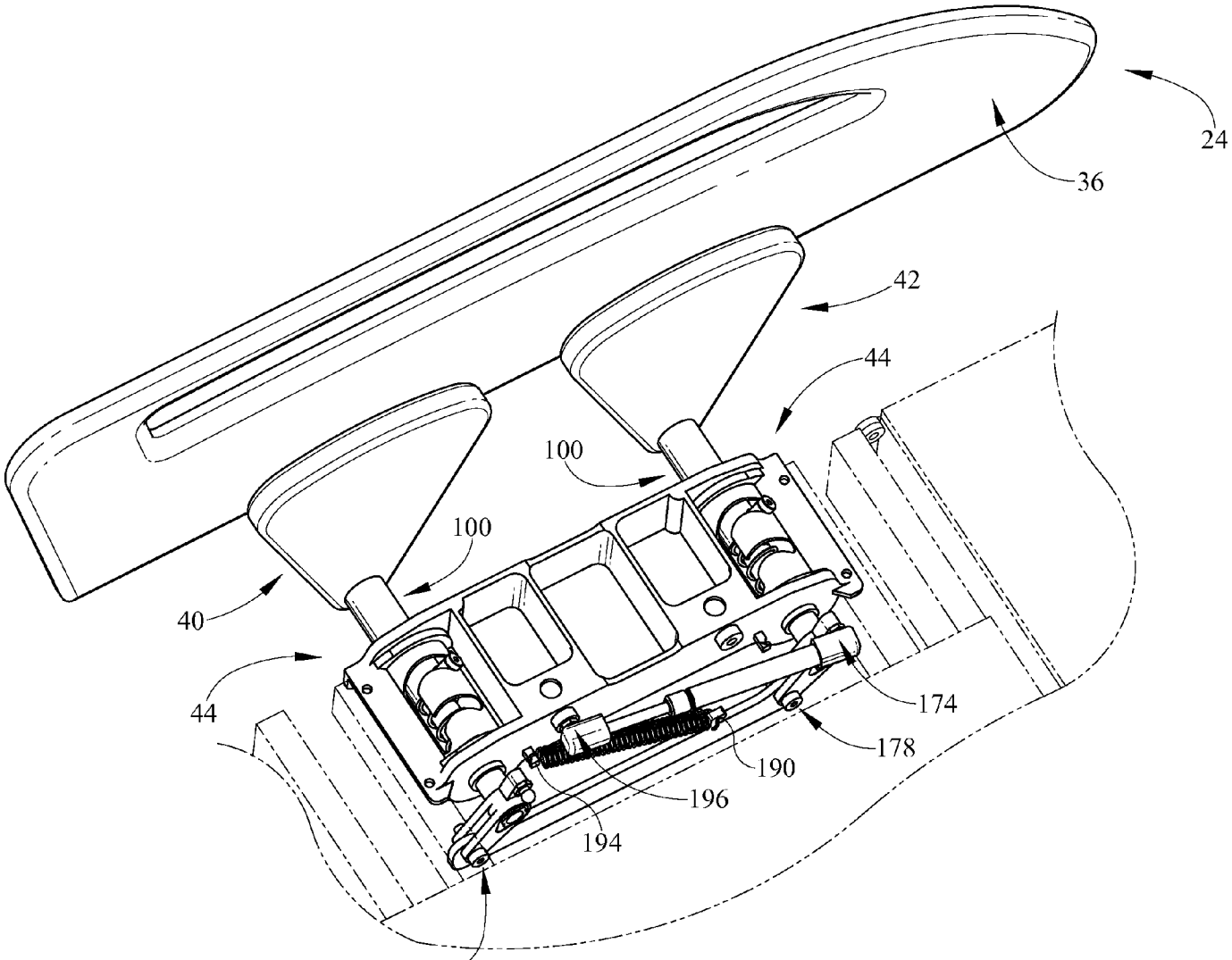
FIG. 2 is a top perspective view of the siderail of FIG. 1 showing the siderail body, support arms, and siderail base assembly.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

In one illustrative embodiment, the siderail configured to move between a storage position and a first deployed position where the siderail body is a first lateral distance from the upper frame and a second deployed position where the siderail body is a second lateral distance from the upper frame.

A person-support apparatus 10 according to one illustrative embodiment of the current disclosure can be shown in FIGS. 1-17. The person-support apparatus 10 can be a hospital bed with a first section F1 or head support section F1, where the head of a person (not shown) can be positioned and a second section S1 or a foot support section S1, where the feet of the person (not shown) can be positioned. The person-support apparatus 10 can have a longitudinal axis X1 that can pass through the head support section F1 and the foot support section S1 and a transverse axis Y1 that can be perpendicular to the longitudinal axis X1. It should be appreciated that the person-support apparatus 10 can also be a hospital stretcher or an operating table. The person-support apparatus 10 can include a lower frame 12 or base 12, a plurality of supports 14 coupled with the lower frame 12, and an upper frame 16 supported on the supports 14 above the lower frame 12. It should be appreciated that, in one illustrative embodiment, the person-support apparatus 10 can support a person-support surface 18 or mattress 18 on the upper frame 16. It should also be appreciated that the supports 14 can be lift mechanisms 14 that can move the upper frame 16 with respect to the lower frame 12.

The upper frame 16 can include an upper frame base 20, a deck 22, a plurality of siderails 24, and endboards EB1 as shown in FIG. 1. The deck 22 can be supported on the upper frame base 20 and can include multiple sections, such as, a head section 26, a foot section 28, and a seat section 30. The sections can be configured to pivot and/or translate with respect to the upper frame base 20 and one another.

The plurality of siderails 24 can include a head siderail 32 or headrail 32 and a foot siderail 34 or footrail 34. The head siderail 32 can be coupled to the head section 26 of the deck 22 and the foot siderail 34 can be coupled to the upper frame base 20 proximate to the foot section 28. It should be appreciated that the headrail 32 can be coupled to the upper frame base 20 proximate the head section 26. It should also be appreciated that the foot siderail 34 can be coupled to the upper frame base 20 proximate to the seat section 30 or coupled to the deck 22 proximate the foot section 28 or seat section 30. The headrail 32 can and the footrail 34 can be similarly constructed and can both include a siderail body 36, a siderail latch 38, first and second support arms 40 and 42, and a siderail base assembly 44. It should be appreciated that the headrail body and the footrail body can be shaped differently. It should also be appreciated that in one illustrative embodiment, portions of the headrail 32 and the footrail 34 can resemble portions of the siderails disclosed in U.S. Patent Application No. 2007/0169268 by Lemire et al. published on Jul. 26, 2007. For the sake of brevity, the elements of the headrail 32 and the footrail 34 will be described together below.

The siderail body 36 can be coupled to the siderail base assembly 44 by the first and second support arms 40 and 42 and can be configured to be moved between first and second deployed positions or raised positions and a storage position or lowered position with respect to the upper frame 16. The siderail body 36 can include a first siderail surface 46, a second siderail surface 48, a siderail perimeter edge 50, a siderail grip portion with a grip opening 52, an overlapping portion 54, a latch opening 56, support arm openings 58 as shown in FIGS. 1-4, 6, and 10. It should be appreciated that the siderail body 36 can include a user interface (not shown) coupled thereto that can be configured to receive an input from a user. It should also be appreciated that the siderail body 36 can be similar to the siderail body disclosed in U.S. Patent Application No. 2007/0169268 by Lemire et al. published on Jul. 26, 2007. In one illustrative embodiment, the first siderail surface 46 can face away from the upper frame 16 and the second siderail surface 48 can face toward the upper frame 16. The first siderail surface 46 can be spaced apart from the second siderail surface 48 a first distance D1 and can cooperate with the second siderail surface 48 and the siderail perimeter edge 50 to define an inner chamber 60 with an inner surface 62. The grip opening 52 can pass through the first siderail surface 46 and the second siderail surface 48 and can cooperate with the siderail perimeter edge 50 to define a grip 64. The overlapping portion 54 can be configured to overlap a portion of an adjacent siderail 24. It should be appreciated that on the overlapping portion 54 of the siderail body 36 the first siderail surface 46 can be spaced apart from the second siderail surface 48 a second distance D2, which can be less than the first distance D1. The latch opening 56 can pass through a portion of the perimeter edge and can be configured to allow a portion of the siderail latch 38 to extend therethrough. It should be appreciated that the latch opening 56 can pass through other portions of the siderail body 36. The support arm openings 58 can pass through the second siderail surface 48 and allow a portion of the first and second support arms 40 and 42 to extend into the inner chamber 60. It should be appreciated that, in one illustrative embodiment, one of the support arm openings 58 can be circular and the other can be oblong (i.e., a slot) to help prevent binding by providing clearance for nonparallel first and second support arm 40 and 42 geometry.

Figure 3:
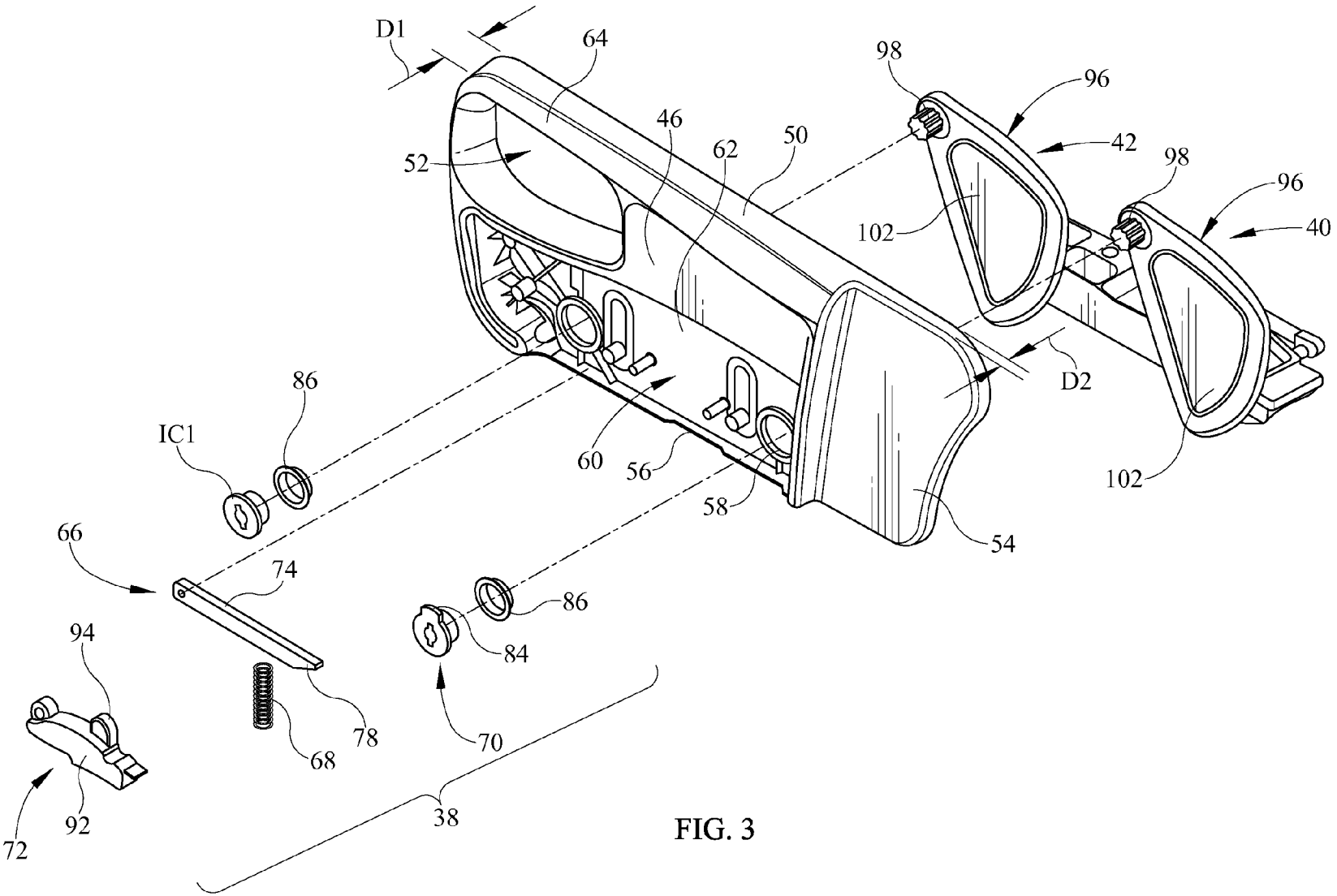
FIG. 3 is an exploded, partial sectional view of the siderail of FIG. 1, showing the elements of the siderail latch and an inner chamber of the siderail body.
Figure 4:
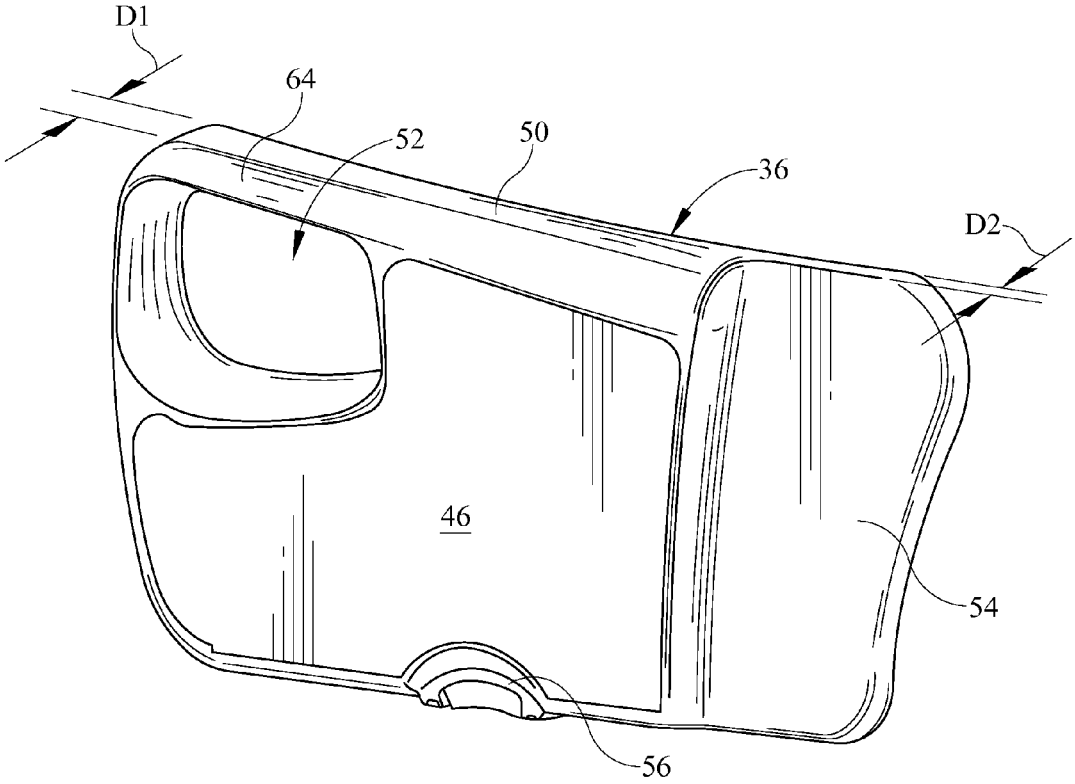
FIG. 4 is a side perspective view of the siderail of FIG. 1 showing the siderail body with the grip portion, overlapping portion, and handle.
Figure 5:
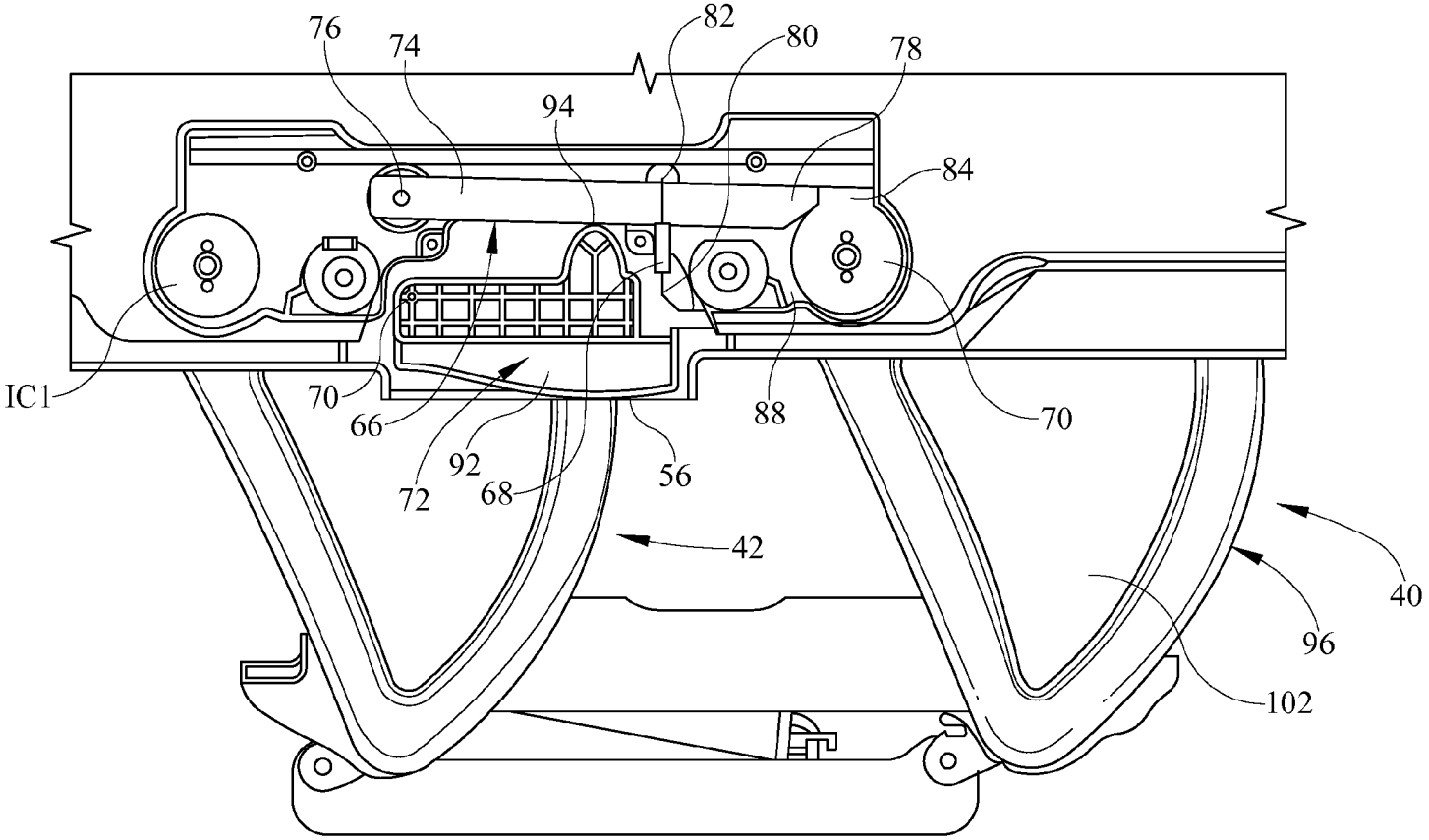
FIG. 5 is a side view of the siderail latch of FIG. 3 showing the locking arm in the first position to maintain the siderail body in a deployed position.
Figure 6:
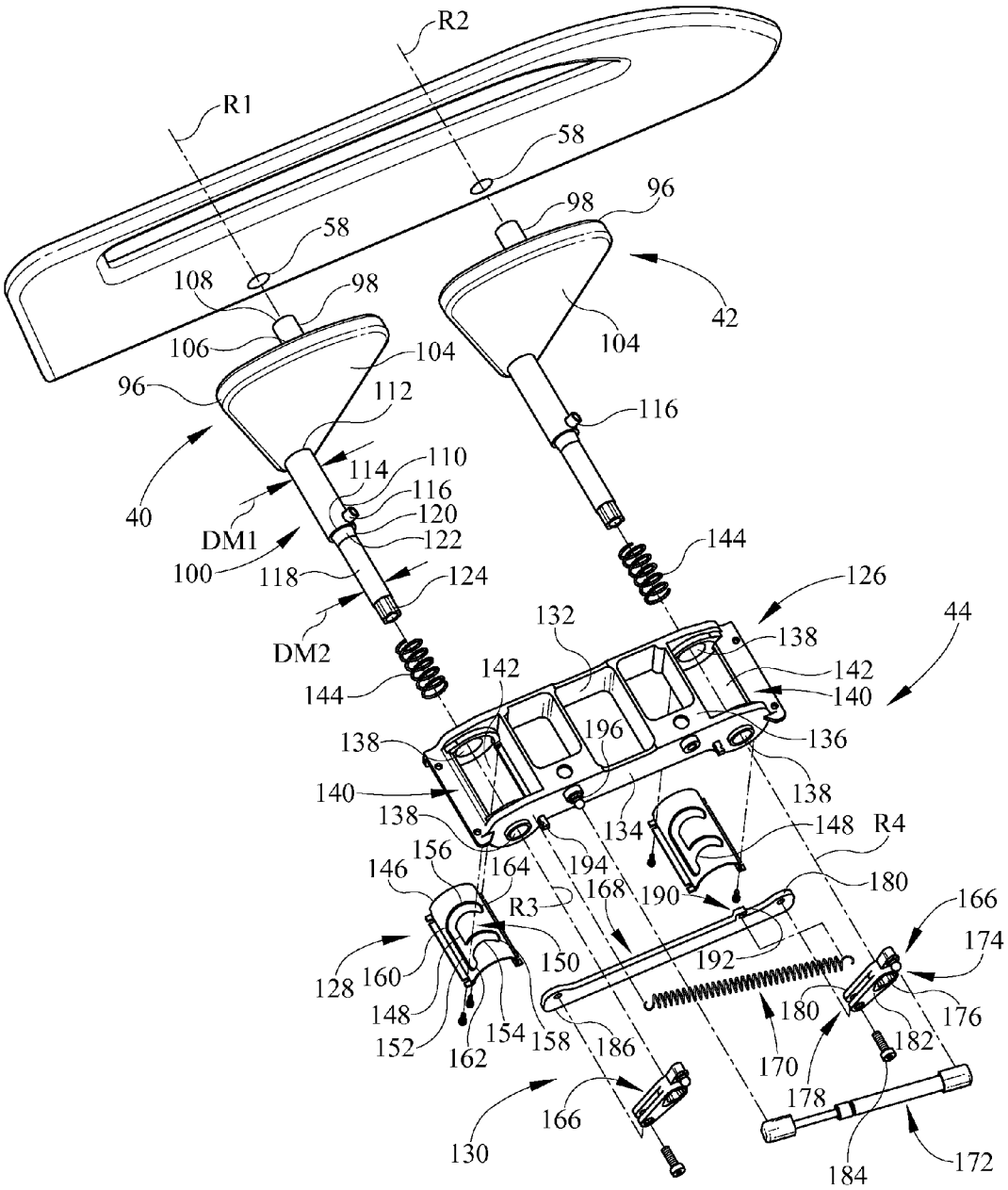
FIG. 6 is an exploded view of the siderail of FIG. 1, showing the elements of the support arms and the siderail base assembly.
Figures 7A, 7B, 7C, 8A, 8B, 8C, 9A, 9B, 9C:
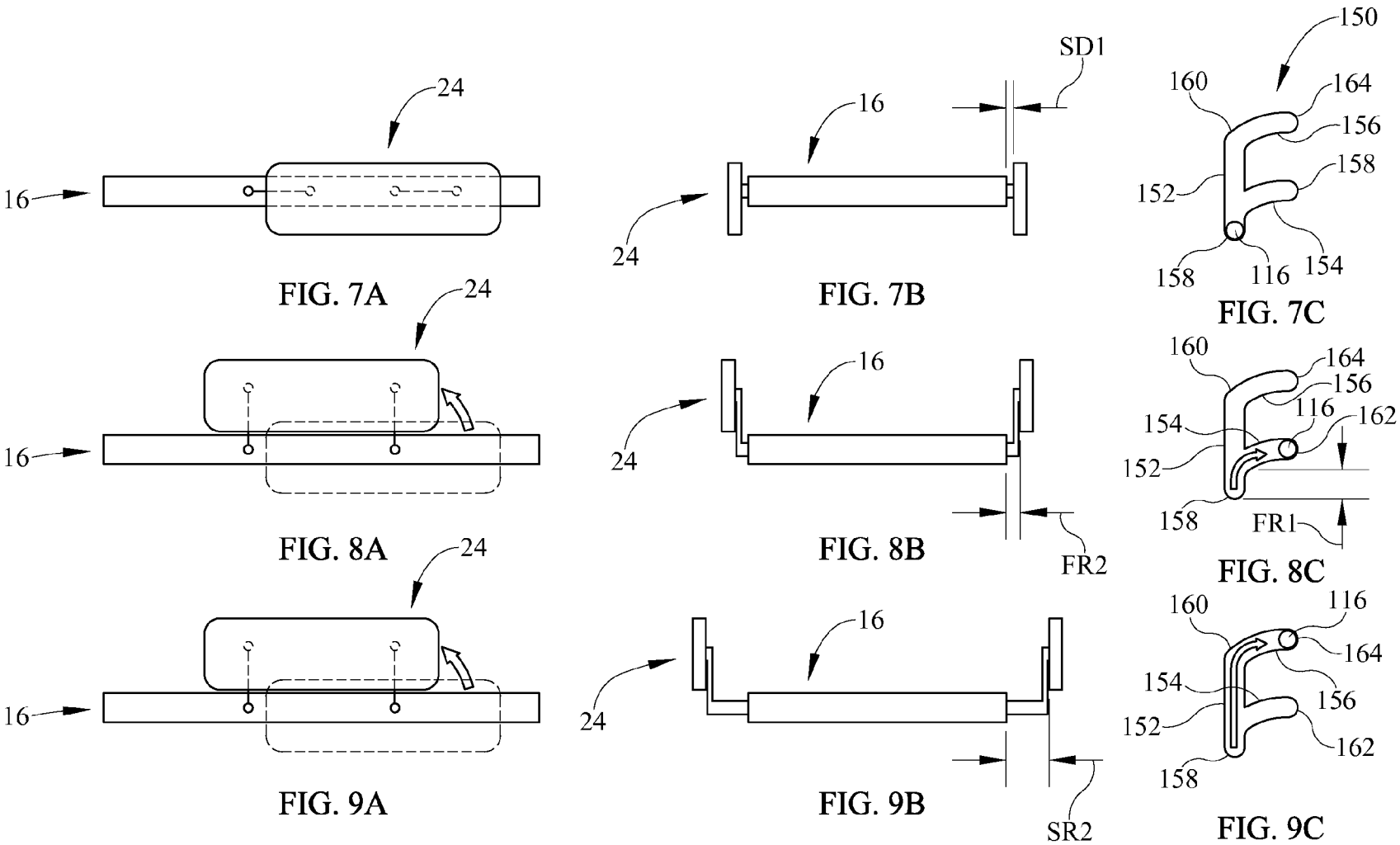
FIGS. 7A-C are diagrammatic views of the siderail of FIG. 1 showing the siderail in the storage position spaced apart a first lateral distance from the upper frame when the protrusion is located proximate the first lateral slot end.
FIGS. 8A-C are diagrammatic views of the siderail of FIG. 1 showing the siderail in the first deployed position spaced apart a second lateral distance from the upper frame when the protrusion is located proximate the first radial slot end.
FIGS. 9A-C are diagrammatic views of the siderail of FIG. 1 showing the siderail in the second deployed position spaced apart a third lateral distance from the upper frame when the protrusion is located proximate the second radial slot end.
Figure 10:
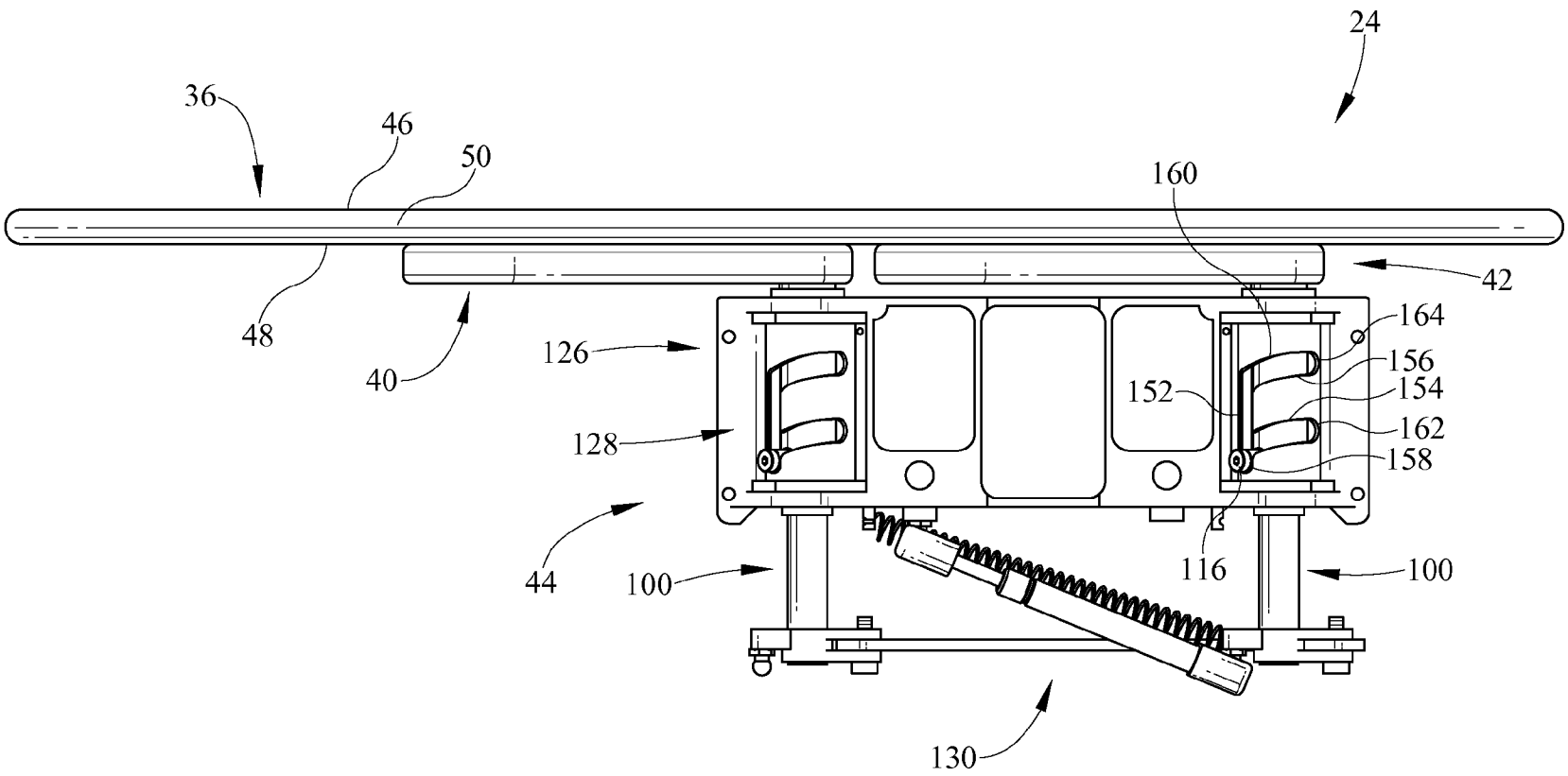
FIG. 10 is a top view of the siderail of FIG. 1, showing the siderail in the storage position.
Figure 11:
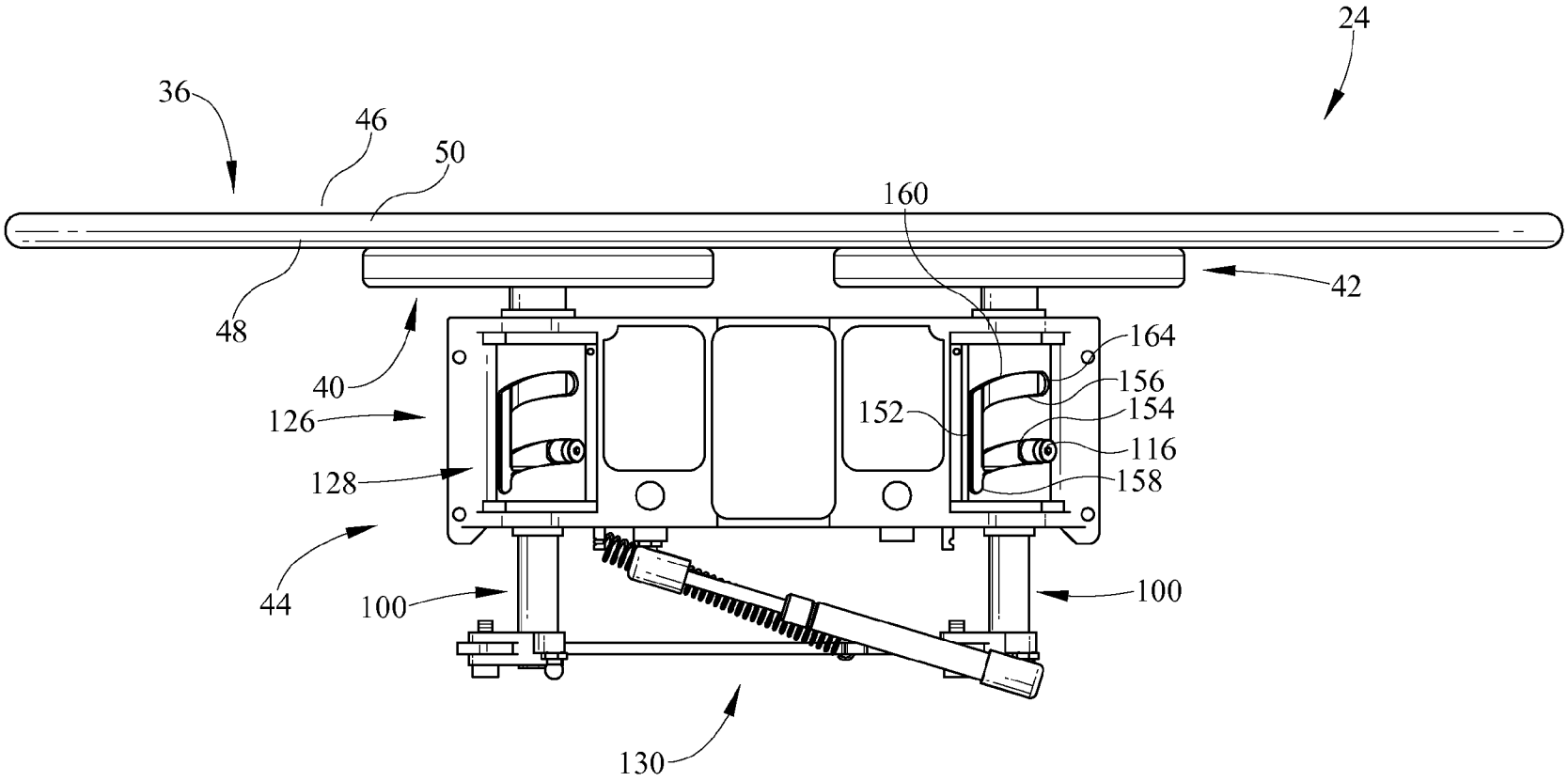
FIG. 11 is a top view of the siderail of FIG. 1, showing the siderail in the first deployed position.
Figure 12:
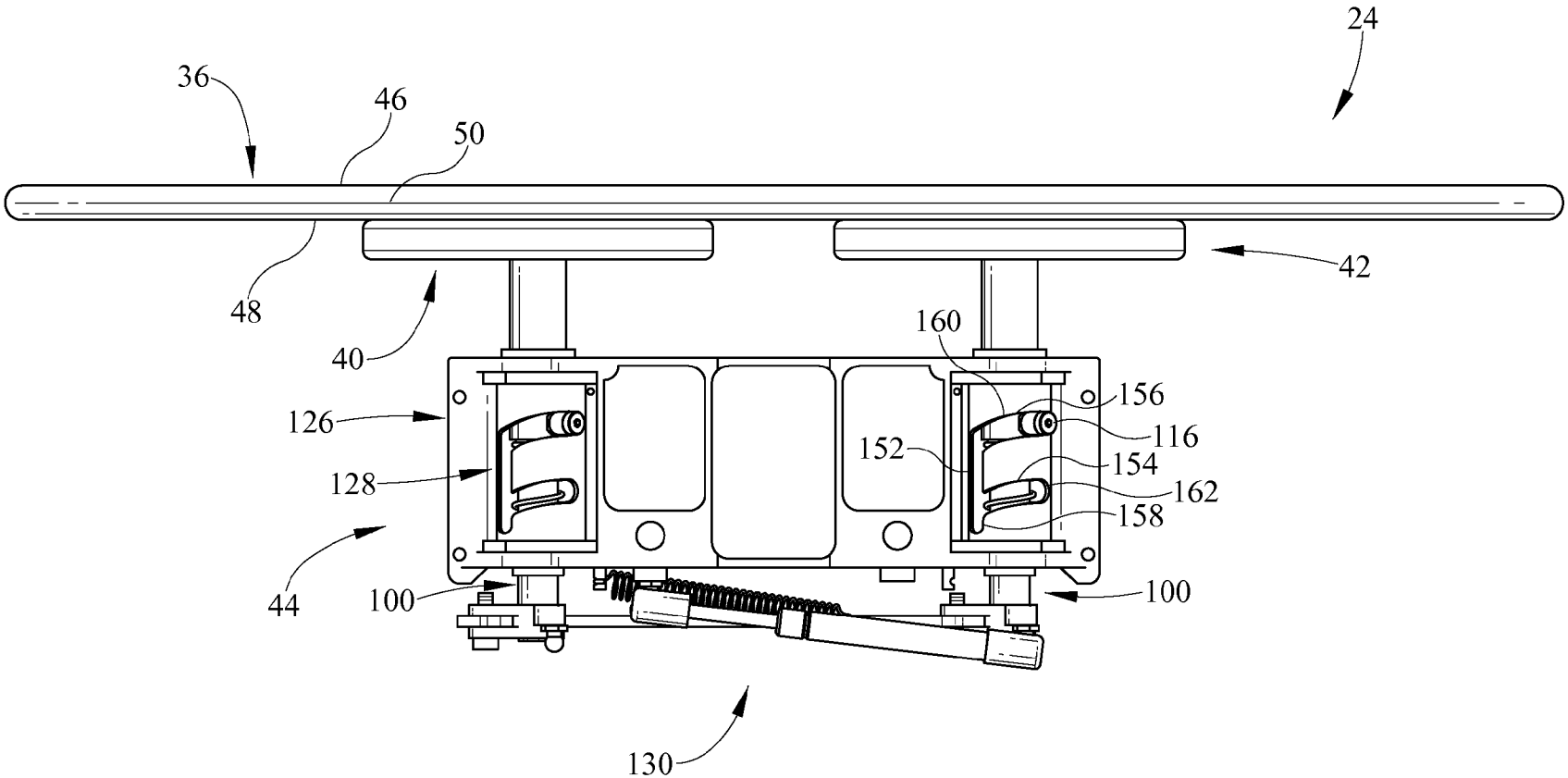
FIG. 12 is a top view of the siderail of FIG. 1, showing the siderail in the second deployed position.
Figure 13:
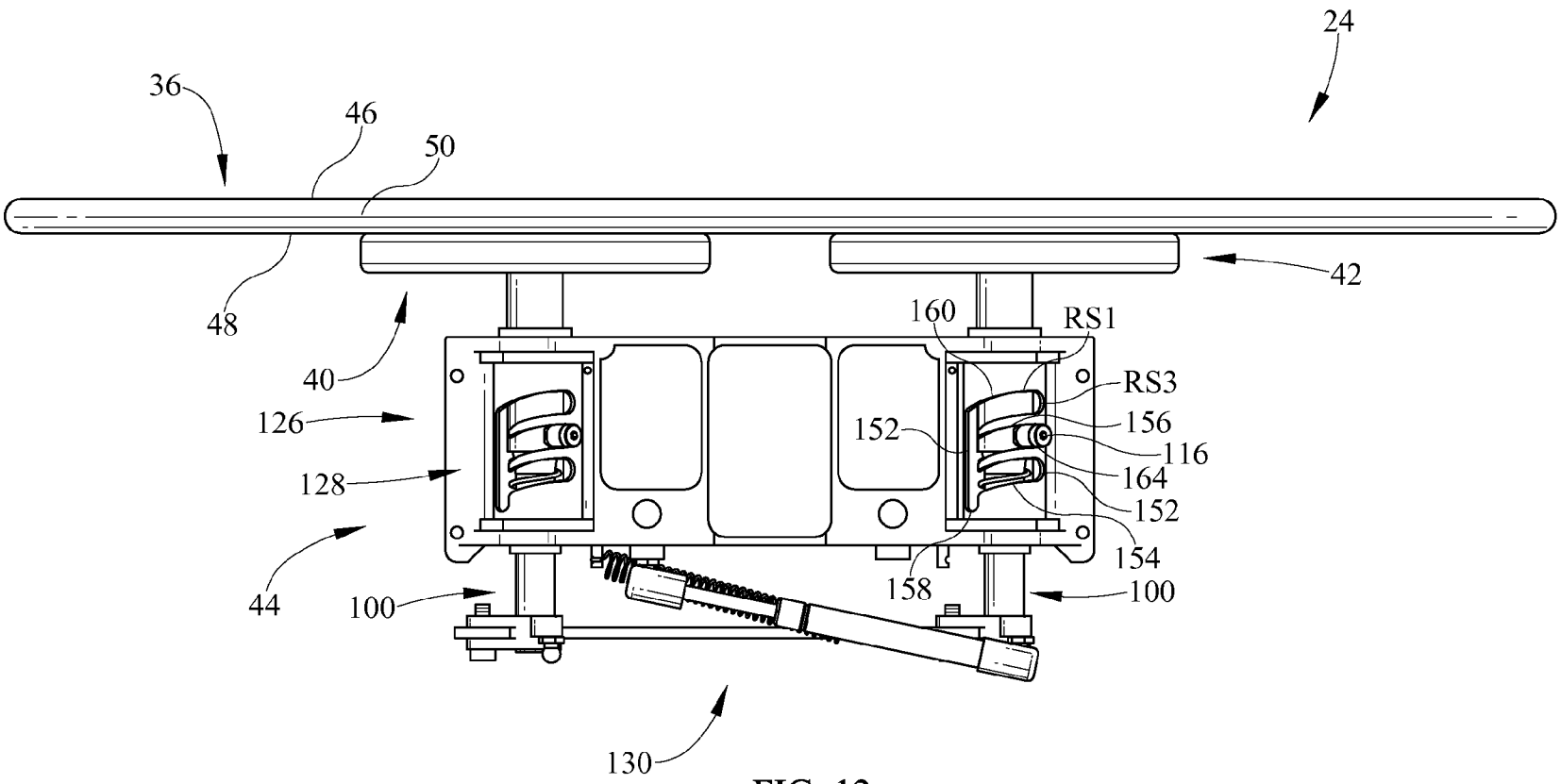
FIG. 13 is a top view of the siderail according to another illustrative embodiment in the second deployed position.
Figures 14A, 14B, 14C, 15A, 15B, 15C, 16A, 16B, 16C, 17A, 17B, 17C:
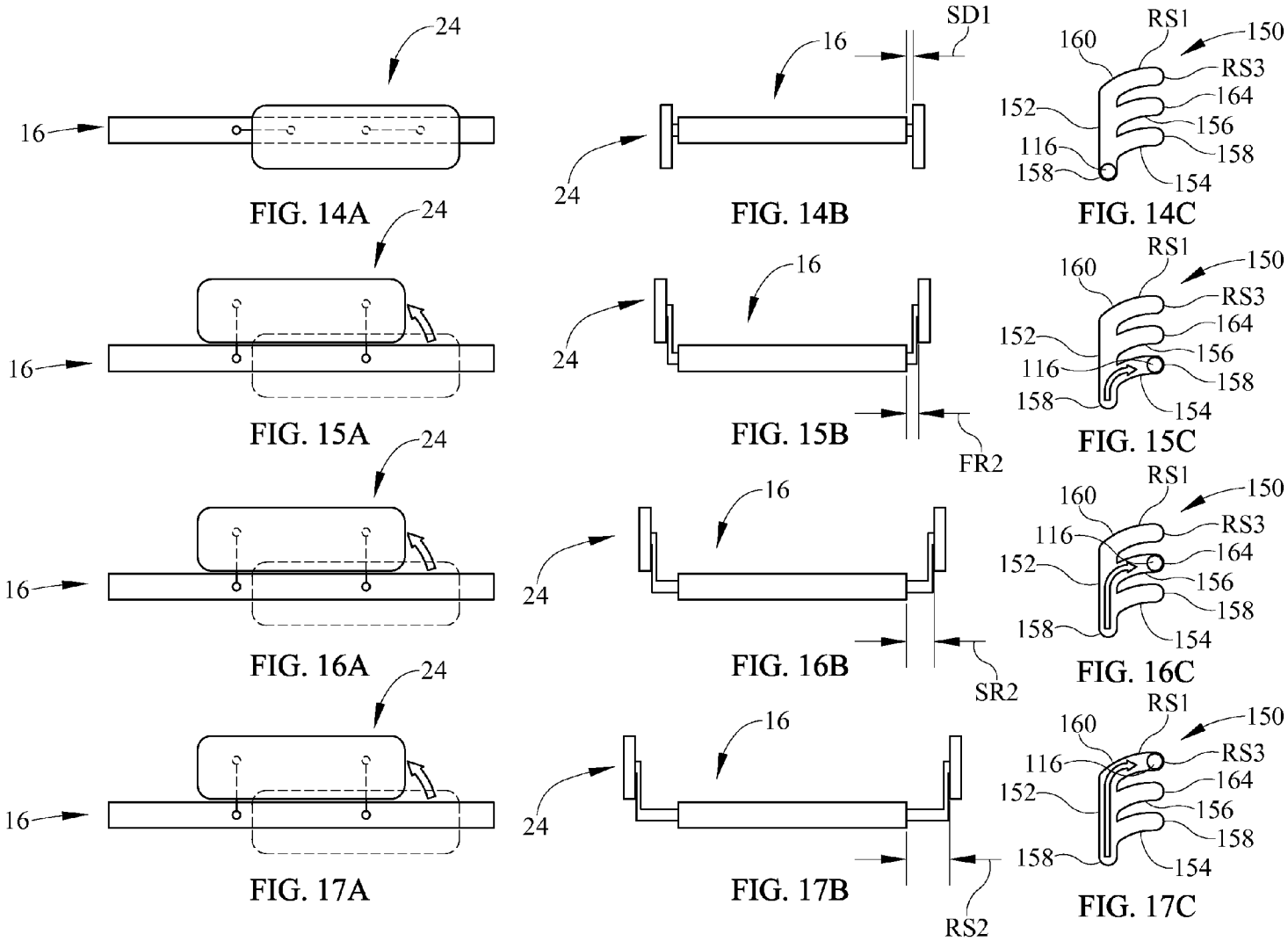
FIGS. 14A-C are diagrammatic views of the siderail of FIG. 13 showing the siderail in the storage position spaced apart a first lateral distance from the upper frame when the protrusion is located proximate the first lateral slot end.
FIGS. 15A-C are diagrammatic views of the siderail of FIG. 13 showing the siderail in the first deployed position spaced apart a second lateral distance from the upper frame when the protrusion is located proximate the first radial slot end.
FIGS. 16A-C are diagrammatic views of the siderail of FIG. 13 showing the siderail in the second deployed position spaced apart a third lateral distance from the upper frame when the protrusion is located proximate the second radial slot end.
FIGS. 17A-C are diagrammatic views of the siderail of FIG. 13 showing the siderail in the third deployed position spaced apart a fourth lateral distance from the upper frame when the protrusion is located proximate the third radial slot end.

The siderail latch 38 can be configured to allow the siderail 24 to be maintained in a specific position, such as, for example, the deployed positions and/or the storage position. It should be appreciated that the siderail latch 38 can be similar to the locking mechanism disclosed in U.S. Patent Application No. 2007/0169268 by Lemire et al. published on Jul. 26, 2007. The siderail latch 38 can include a locking arm 66, a latch spring 68, a locking cog 70, and a handle 72 as shown in FIGS. 3-5. It should be appreciated that the siderail latch 38 can include a sensor (not shown) configured to detect and/or monitor an inclination/orientation of the locking arm 66 to alert a control system (not shown) that the siderail 24 is locked in the deployed positions and/or unlocked in the deployed positions, storage position, or moving between the deployed and storage positions. The locking arm 66 can include a first locking arm end 74 that can be pivotally mounted within the inner chamber 60 of the siderail body 36 at a first latch joint 76, and a second locking arm end 78 that can be configured to engage the locking cog 70 and prevent the locking cog 70 from rotating in a first locking arm position. It should be appreciated that the second locking arm end 78 can be configured to disengage the locking cog 70 as the locking arm 66 moves toward a second locking arm position to allow the locking cog 70 to rotate with respect to the siderail body 36.

The latch spring 68 can be configured to bias the locking arm 66 toward the first locking arm position. The latch spring 68 can be coupled within the inner chamber 60 at a first spring joint 80 and can be coupled to the locking arm 66 at a second spring joint 82 as shown in FIG. 3. The latch spring 68 can be configured to expand from a first length to a second length and contract from the second length to the first length. In one illustrative embodiment, the latch spring 68 can be the first length when the locking arm is in the first locking arm position and the second length when the locking arm is in the second locking arm position.

The locking cog 70 can be configured to maintain the position of the siderail body 36 with respect to the upper frame 16 when the locking cog 70 is in a first locking cog position and allow the siderail body 36 to move with respect to the upper frame 16 when the locking cog 70 is in a second locking cog position. The locking cog 70 can be coupled to one of the first and second support arms 40 and 42 and can be positioned within the inner chamber 60 as shown in FIG. 3. The locking cog 70 can be configured to rotate as the first and second support arms 40 and 42 move the siderail body 36 between the deployed positions and the storage position. In one illustrative embodiment, the locking cog 70 can be coupled to the second support arm 42. The locking cog 70 can be substantially circular and can include a cog protrusion 84 configured to selectively engage the locking arm 66 to prevent rotation of the locking cog 70. It should be appreciated that the locking cog 70 can rotate against a bearing 86 configured to be seated against the inner surface 62 proximate to the support arm openings 58. It should also be appreciated that a stop 88 can be positioned within the inner chamber 60 and can define the storage position of the siderail 24 or third locking cog position by engaging the cog protrusion 84 to limit the rotation of the locking cog 70 when the locking arm 66 is in the second locking arm position and is not engaging the cog protrusion 84.

The handle 72 can be movably coupled within the inner chamber 60 at a first handle joint 90 and can be configured to move between a first latch position or locked position and a second latch position or unlocked position. The handle 72 can include a grip portion 92 and a handle protrusion 94 as shown in FIGS. 3-5. The grip portion 92 can be configured to extend through the latch opening 56 when the handle 72 is in the first latch position. The handle protrusion 94 can be configured to engage the locking arm 66 when the handle 72 is in the first latch position and move the locking arm 66 from the first locking arm position toward the second locking arm position as the handle 72 moves from the first latch position toward the second latch position. It should be appreciated that the handle 72 can be moved from the second latch position to the first latch position by the locking arm 66 as the latch spring 68 contracts from the second length K2 to the first length K1 and causes the locking arm 66 to move toward the first locking arm position.

The first and second support arms 40 and 42 can be movably coupled to the siderail body 36 via the siderail latch 38 and movably coupled to the siderail base assembly 44 as shown in FIGS. 1-3, 5, 6, and 10-13. It should be appreciated that the first and second support arms 40 and 42 can be similar to the support arms disclosed in U.S. Patent Application No. 2007/0169268 by Lemire et al. published on Jul. 26, 2007. The first and second support arms 40 and 42 can be configured to cooperate with the siderail base assembly 44 and the siderail body 36 to move the siderail body 36 between the deployed positions and the storage position with respect to the upper frame base 20.

The first and second support arms 40 and 42 can include a support arm body 96, an upper shaft 98, and a lower shaft 100 as shown in FIGS. 1-3, 5, 6, and 10-13. The support arm body 96 can include a first support arm surface 102 facing toward the siderail body 36 and a second support arm surface 104 facing toward the siderail base assembly 44. In one illustrative embodiment, the support arm body 96 can be substantially wedge-shaped and can define an angle between the first and second support arms 40 and 42 and a bottom edge of the siderail body 36 that can remain obtuse during the rotational movement of the siderail body, which can help avoid the creation of pinch points between the first and second support arms 40 and 42 and the bottom edge of the siderail body 36. It should be appreciated that the support arm body can be other shapes, such as, for example, trapezoidal, round, or including sides curved in a convex or concave manner.

The upper shaft 98 of the first support arm 40 can rotate about a first rotational axis R1 with respect to the siderail body 36 and the upper shaft 98 of the second support arm 42 can rotate about a second rotational axis R2 with respect to the siderail body 36 as shown in FIGS. 1-3, 5, 6, and 10-13. The lower shaft 100 of the first support arm 40 can rotate about a third rotational axis R3 with respect to the siderail base assembly 44 and the lower shaft 100 of the second support arm 42 can rotate about a fourth rotational axis R4 with respect to the siderail base assembly 44.

The upper shaft 98 can include a first upper shaft end 106 that can be coupled to the first support arm surface 102 and a second upper shaft end 108 that can be coupled to the siderail latch 38 as shown in FIGS. 1-3, 5, 6, and 10-13. It should be appreciated that the upper shaft 98 can be similar to the upper pivot disclosed in U.S. Patent Application No. 2007/0169268 by Lemire et al. published on Jul. 26, 2007. In one illustrative embodiment, the first upper shaft end 106 on the first support arm 40 can extend from the first support arm surface 102 and the second upper shaft end 108 can be coupled to the locking cog 70. It should be appreciated that the first upper shaft end 106 on the second support arm 42 can extend from the first support arm surface 102 of the support arm body 96 and the second upper shaft end 108 can be coupled to an idler cog IC1 and/or bearing 86.

The lower shaft 100 can be configured to rotate with respect to the siderail base assembly 44 between the deployed position and the storage position. The lower shaft 100 can include a first lower shaft portion 110 with a first end 112, a second end 114, and a follower 116 or protrusion 116, and a second lower shaft portion 118 with first end 120, a spring seat 122, and a second end 124 as shown in FIGS. 2, 6, and 10-13. It should be appreciated that the lower shaft 100 can be similar to the lower pivot disclosed in U.S. Patent Application No. 2007/0169268 by Lemire et al. published on Jul. 26, 2007. The first lower shaft portion 110 can have a first diameter DM1 and the second lower shaft portion 118 can have a second diameter DM2 that can be less than the first diameter DM1. It should be appreciated that the first lower shaft portion 110 and the second lower shaft portion 118 can have the same diameter. The first end 112 of the first lower shaft portion 110 can be coupled to the second support arm surface 104 and the second end 114 of the first lower shaft portion 110 can cooperate with the first end 120 of the second portion 118 to define the spring seat 122. The protrusion 116 can extend from the surface of the first lower shaft portion 110 and can cooperate with a portion of the siderail base assembly 44 to allow the lower shaft 100 to translate along the transverse axis Y1 with respect to the siderail base assembly 44. It should be appreciated that the third rotational axis R3 and the fourth rotational axis R4 can be parallel to the transverse axis Y1. It should also be appreciated that the protrusion 116 can include a bearing assembly (not shown) coupled thereto that can be configured to reduce wear caused by friction between the protrusion 116 and the siderail base assembly 44. The second end 124 of the second lower shaft portion 118 can be configured to be coupled to a portion of the siderail base assembly 44 that can be configured to dampen the rotation of the lower shafts 100 with respect to the siderail base assembly 44.

The siderail base assembly 44 can be coupled to the upper frame 16 and the first and second support arms 40 and 42 and can include a siderail base frame 126, a guide assembly 128, and a dampening system 130 as shown in FIGS. 2, 6, and 10-13. In one illustrative embodiment, the siderail base assembly 44 of the footrail 34 can be coupled to the foot section 28 of the upper frame base 20 and/or the siderail base assembly 44 of the headrail 32 can be coupled to the head section 26 of the deck 22. The siderail base frame 126 can include a front base frame surface 132, a back base frame surface 134, and a top base frame surface 136 coupled between the front base frame surface 132 and the back base frame surface 134. It should be appreciated that the siderail base assembly 44 can be similar to the cross member disclosed in U.S. Patent Application No. 2007/0169268 by Lemire et al. published on Jul. 26, 2007. The front base frame surface 132 and the back base frame surface 134 can have concentrically aligned shaft openings 138 configured to receive the lower shafts 100. It should be appreciated that the front base frame surface 132 and the back base frame surface 134 can include bearings (not shown) configured to engage the lower shafts 100. The top base frame surface 136 can include guide mount portions 140 that can be positioned above the shaft openings 138. The guide mount portions 140 can include guide mount openings 142 that can allow the protrusions 116 on the lower shafts 100 to pass through and engage the guide assembly 128.

The guide assembly 128 can include guide springs 144 and guides 146 and can be configured to help move the siderail body 36 between a first lateral position and a second lateral position with respect to the siderail base assembly 44. The guide springs 144 can be configured to be positioned between the front base frame surface 132 and the back base frame surface 134 as shown in FIGS. 2 and 6-17. The guide springs 144 can be helically shaped and the second lower shaft portion 110 can pass through the center thereof. The guide springs 144 can be configured engage the back base frame surface 134 and the spring seat 122.

The guides 146 can be coupled to the guide mount portions 140 of the siderail base frame 126 and can be configured to cooperate with the protrusions 116 on the lower shaft 100 to move the siderail body 36 along the lateral axis Y1 between a first lateral position and a second lateral position and between the deployed and storage positions. It should be appreciated that the guides 146 can be integrated into the upper frame base 20. The guides 146 can include a guide opening 148 that can define a guide path 150 as shown in FIGS. 2, 6, and 10-13. The guide path 150 can include a lateral slot 152, a first radial slot 154, and a second radial slot 156. It should be appreciated that the guide path 150 can include more than two radial slots as shown in FIGS. 13-17. The lateral slot 152 can include a first lateral slot end 162 and a second lateral slot end 160 and can be configured to allow the siderail body 36 to translate along the transverse axis Y1 when the siderail body 36 is in the storage position. In one illustrative embodiment, the siderail body 36 can be a first lateral distance SD1 from the siderail base frame 126 in the first lateral position when the protrusion 116 is proximate the first lateral slot end 162, and a second lateral distance from the siderail base frame 126 in the second lateral position when the protrusion 116 is proximate the second lateral slot end 160.

The first radial slot 154 can extend from the lateral slot 152 and can be spaced a distance FR1 from the first lateral slot end 162 as shown in FIGS. 2, 6, and 10-17. It should be appreciated that the first radial slot 154 can extend from the first lateral slot end 162. The siderail body 36 can move between the storage position and the deployed position as the protrusion 116 moves along the first radial slot 154. The first radial slot 154 can include a first radial slot end 162 configured to space the siderail body 36 a second lateral distance FR2 from the siderail base frame 126 when protrusion 116 is positioned proximate to the first radial slot end 162 and the siderail body 36 is in the first deployed position.

The second radial slot 156 can extend from the second lateral slot end 160 as shown in FIGS. 2, 6, and 10-17. The siderail body 36 can move between the storage position and the deployed position as the protrusion 116 moves along the second radial slot 156. The second radial slot 156 can include a second radial slot end 164 configured to space the siderail body 36 a third lateral distance SR2 from the siderail base frame 126 when protrusion 116 is positioned proximate to the second radial slot end 164 and the siderail body 36 is in the second deployed position. It should be appreciated that a third radial slot RS1 can be configured to space the siderail body 36 a fourth lateral distance RS2 from the siderail base frame 126 when protrusion 116 is positioned proximate to the third radial slot end RS3 and the siderail body 36 is in the third deployed position as shown in FIGS. 13-17.

The dampening system 130 can include shaft links 166, a damper link 168, a damper spring 170, and a damper 172 as shown in FIGS. 2, 6, and 10-13. It should be appreciated that the dampening system 130 can be similar to the dampening system disclosed in U.S. Patent Application No. 2007/0169268 by Lemire et al. published on Jul. 26, 2007. The shaft links 166 can be configured to be coupled to the lower shaft 100, the damper link 168, and the damper 172 and can help coordinate movement of the dampening system 130 with the movement of the siderail body 36 and the first and second support arms 40 and 42. The shaft links 166 can include a first damper joint 174, a shaft opening 176, and a damper link joint 178. In one illustrative embodiment, the damper joint 174 can be a fastener configured to couple to a portion of the damper 172. The shaft opening 176 can be positioned between the damper joint 174 and the damper link joint 178, and can be configured to be coupled to the second end 124 of the second lower shaft portion 118. The damper link joint 178 can include a slot 180 that can be configured to receive the damper link 168 and an opening 182 through the slot 180 configured to receive a fastener 184 to couple the damper link 168 to the shaft link 166.

The damper link 168 can include a first link end 186, a second link end 188, and a first spring joint 190 as shown in FIGS. 2, 6, and 10-13. The first link end 186 can be coupled to one of the shaft links 166 at the damper link joint 178 and the second link end 188 can be coupled to the other of the shaft links 166 at the damper link joint 178. The first spring joint 190 can be positioned between the first link end 186 and the second link end 188 and can include a spring retainer 192 configured to engage a part of the damper spring 170. In one illustrative embodiment, the spring retainer 192 can be hook shaped.

The damper spring 170 can be coupled to the damper link 168 at the first spring joint 190 and coupled to the siderail base frame 126 at a second spring joint 194 as shown in FIGS. 2, 6, and 10-13. The damper spring 170 can be configured to expand from a first spring length to a second spring length as the siderail 24 moves from the deployed position to the storage position, and from the second spring length to the first spring length as the siderail 24 moves from the storage position to the deployed position.

The damper 172 can be coupled to one of the shaft links 166 at the first damper joint 174 and coupled to the siderail base frame 126 at a second damper joint 196 as shown in FIGS. 2, 6, and 10-13. The damper 172 can be configured to slow the movement of the siderail body 36 as the siderail body 36 moves from the deployed position to the storage position and/or the storage position to the deployed position. In one illustrative embodiment, the damper 172 can be a spring damper 172. In another illustrative embodiment, the damper 172 can be a gas damper 172.

In operation, the siderail body 36 can be in the storage position with respect to the upper frame 16 and the protrusions 116 on the lower shafts 100 can be positioned proximate the first lateral slot ends 158 of the guides 146. A user can grip the siderail body and move the siderail body 36 and first and second support arms 40 and 42 laterally along the lateral axis Y1 with respect to the siderail base assembly 44. As the siderail body 36 moves laterally, the protrusions 116 on the lower shafts 100 can move along the lateral slots 152 of the guides 146. Depending on the desired lateral position of the siderail body 36 with respect to the upper frame 16, the protrusions 116 can be moved a distance FR1 from the first lateral slot ends 158 to access the first radial slots 154 or moved from the first lateral slot ends 158 to the second lateral slot ends 160 to access the second radial slots 156. Once the protrusions 116 are proximate the first radial slots 154 or the second radial slots 156 the siderail body 36 can be rotated from the storage position to the deployed position. As the siderail body 36 is rotated, the upper shaft 98 can rotate the locking cog 70 about the first rotational axis R1 and the lower shafts 100 can rotate about the third and fourth rotational axis R3 and R4. As the lower shafts 100 rotate, the protrusions 116 can move along the one of the first radial slots 154 toward the first radial slot end 162 and the second radial slots 156 toward the second radial slot end 164. When the protrusions 116 are positioned in the first radial slot end 162 or the second radial slot end 164, the locking cog 70 can engage the locking arm 66 to maintain the siderail body 36 in the deployed position.

To move the siderail body 36 from the deployed position to the storage position, the handle 72 of the siderail latch 38 can be actuated and can cause the locking arm 66 to move from the first locking arm position to the second locking arm position. When the locking arm 66 is in the second locking arm position the locking cog 70 is able to rotate and the siderail body 36 and first and second support arms 40 and 42 can be moved toward the storage position. As the siderail body 36 moves toward the storage position, the lower shafts 100 can rotate about the third and fourth rotational axis R3 and R4 and can cause protrusions 116 to move along one of the first radial slots 154 and the second radial slots 156 from the first radial slot end 162 or second radial slot end 164, respectively, toward the lateral slot 152. Once the protrusions 116 are in the lateral slots 152, the siderail body 36 can be moved laterally along the lateral axis Y1 to the storage position such that the protrusions 116 are positioned proximate the first lateral slot ends 158.

Figure 18:
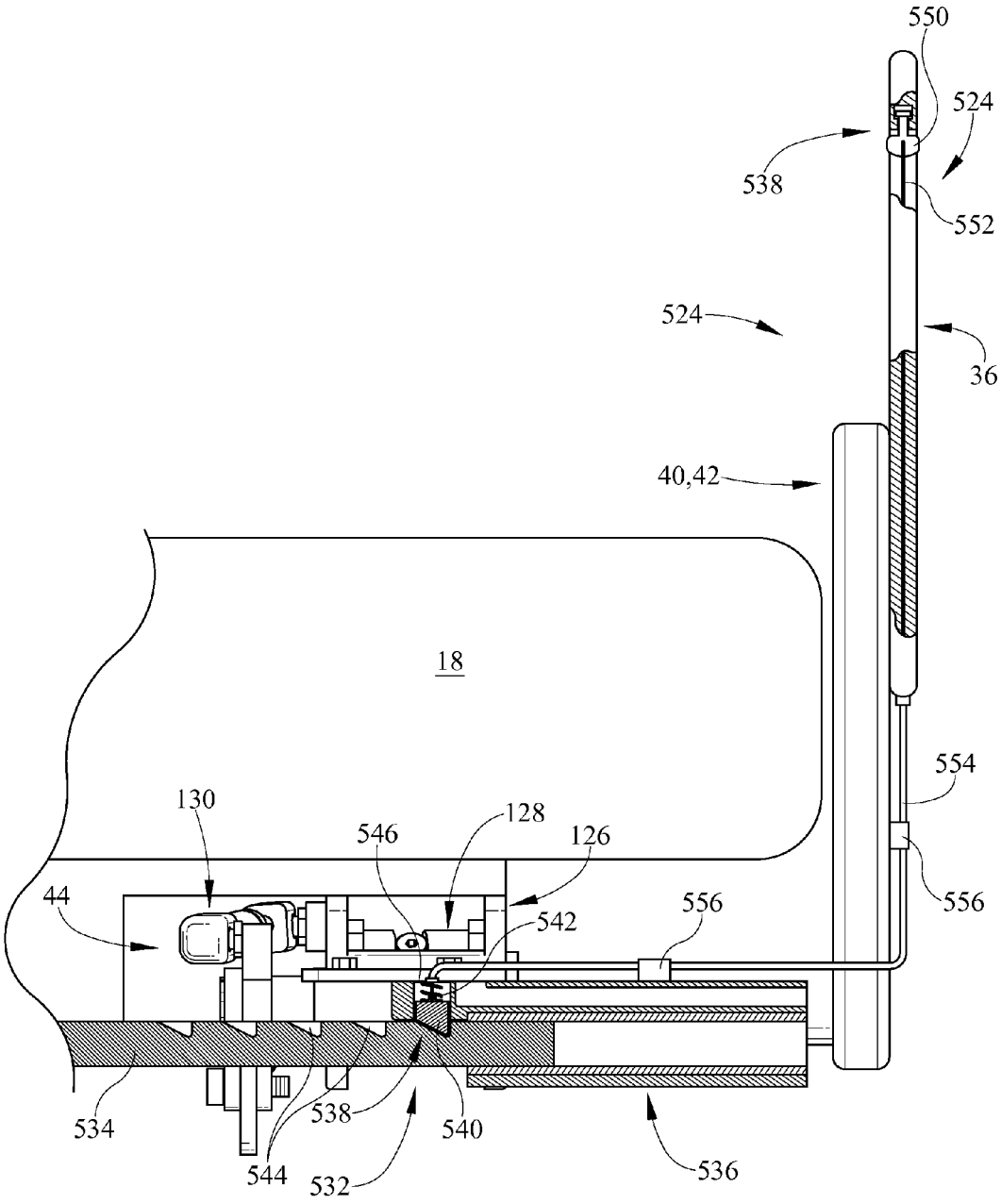
FIG. 18 is a partial sectional side view of the siderail according to another illustrative embodiment of the current disclosure including a the lateral translation mechanism.
Figure 19:
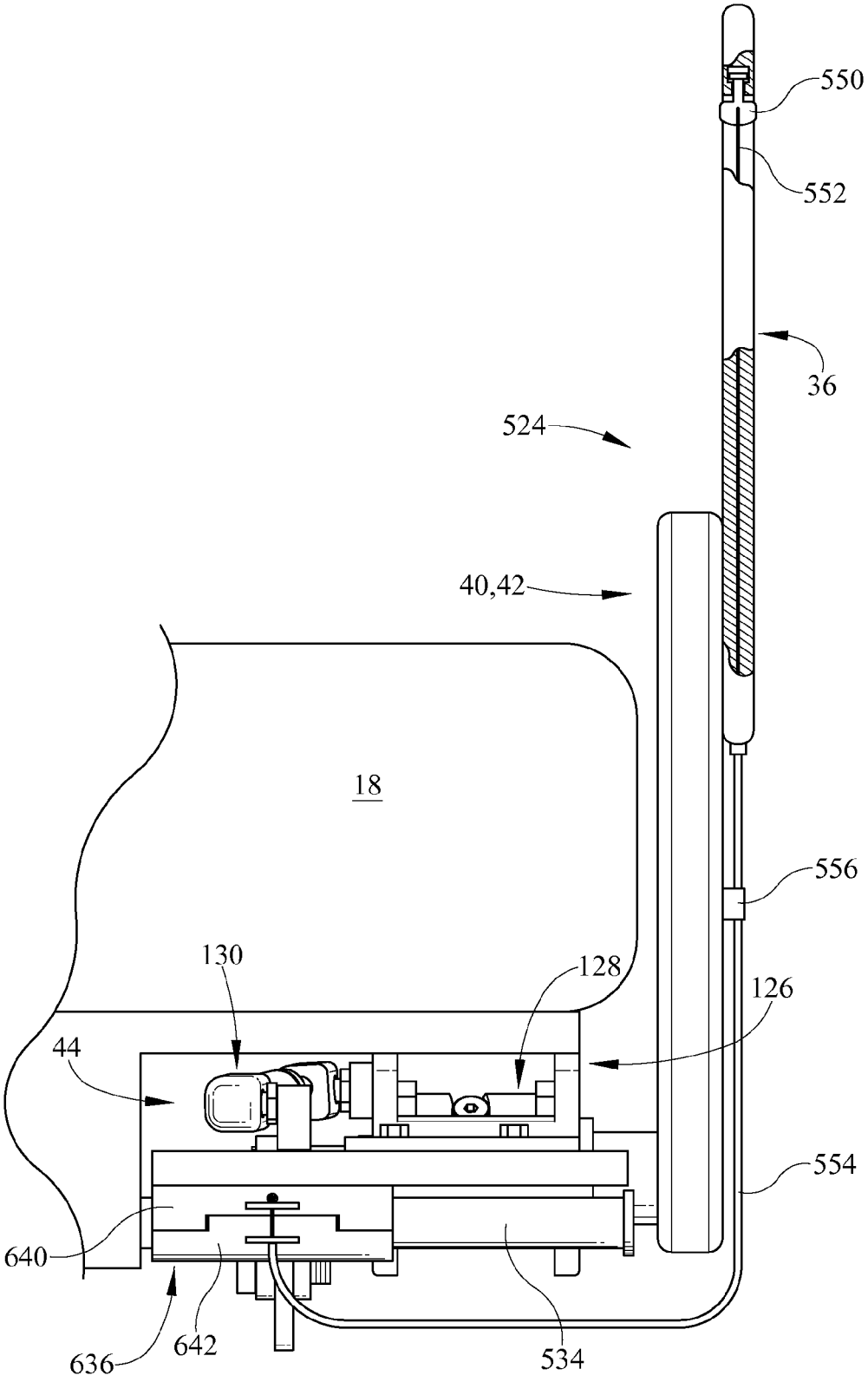
FIG. 19. is a partial sectional side view of the siderail of FIG. 18 showing a lateral translation mechanism according to another illustrative embodiment of the current disclosure.
Figure 20:
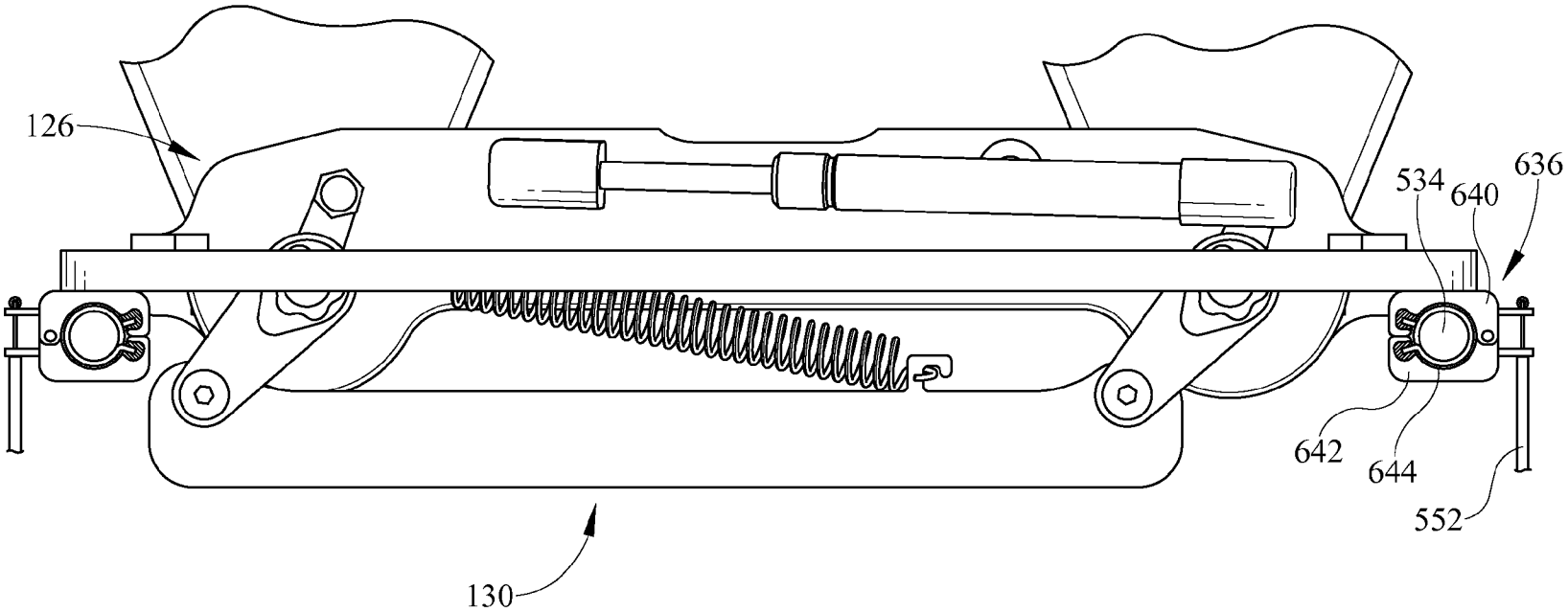
FIG. 20 is a rear view of the lateral translation mechanism of FIG. 18.

A siderail 524 according to another illustrative embodiment of the current disclosure can be shown in FIGS. 18-20. The siderail 524 can include a siderail body 36, a siderail latch assembly 538, first and second support arms 40 and 42, and a siderail base assembly 44. The siderail base assembly 44 can include a siderail base frame 126, a guide assembly 128, a dampening system 130, and a lateral translation mechanism 532. It should be appreciated that the siderail base frame 126, the guide assembly 128, and the dampening system 130 can be similar to the corresponding systems disclosed in U.S. Patent Application No. 2007/0169268 by Lemire et al. published on Jul. 26, 2007.

The lateral translation mechanism 532 can couple the siderail base frame 126 to the upper frame 16 and can include lateral members 534, slides 536, and locking mechanisms 538 as shown in FIGS. 18-20. The lateral members 534 can be coupled to and can extend laterally from the upper frame 16. In one illustrative embodiment, the lateral members 534 can be cylindrical tubes. The slides 536 can be coupled to the siderail base frame 126 and can be movably coupled to the lateral members 534. The slides 536 can be configured to circumferentially surround a portion of the lateral members 534 and can selectively move along the lateral members 534 with the siderail base frame 126. In one illustrative embodiment, the slides 536 can be cylindrical tubes having an inner diameter larger than the outer diameter of the lateral members 534.

The locking mechanism 538 can be coupled to the slides 536 and can be configured to selectively maintain the position of the slide 536 with respect to the lateral members 534. In one illustrative embodiment, the locking mechanism 538 can include a wedge 540 positioned in an opening 542 in the slide 536 that can be configured to engage recessed portions 544 in the lateral members 534 to selectively maintain the position of the slide 536 and siderail base frame 126 with respect to the lateral members 534 as shown in FIG. 18. It should be appreciated that a spring 546 can be positioned in the opening 542 to maintain the wedge 540 in the recessed portions 544. In another illustrative embodiment, the slide 636 can be the locking mechanism 638 and can be include an upper portion 640 movably coupled to a lower portion 642 that can cooperate together to act as a clamp and engage the lateral members 534 to selectively maintain the position of the slide 636 and the siderail base frame 126 as shown in FIGS. 19 and 20. It should be appreciated that the locking mechanism 638 can include a spring 644 that can be configured to engage the upper portion 640 and the lower portion 642 and bias the upper portion 640 and the lower portion 642 towards one another such that they act as a clamp to maintain the position of the slides 636. It should also be appreciated that the siderail latch assembly 538 can cause a portion of the upper portion and/or a portion of the lower portion 642 to move away from the other to allow the slides 636 to move along the lateral members 534.

The siderail latch assembly 538 can include a lateral latch system 548 configured to allow the siderail 524 to move between a first lateral position and a second lateral position. It should be appreciated that the siderail latch assembly 38 described above can be configured to include the lateral latch system 548. The lateral latch system 548 can include a handle 550 and a cable 552 that can be surrounded by an outer cover 554. It should also be appreciated that the cable 552 can pass through a portion of the siderail body 36 and can be routed using routing clips 556 as shown in FIGS. 18-20. The handle 550 can be coupled to the grip 64 and can be configured to move the cable 552 when the handle 550 is moved from a first handle position to a second handle position with respect to the grip 64. In one illustrative embodiment, the handle 550 is recessed into the grip 64.

The cable 552 can be coupled to the handle 550 and the locking mechanism 538 and can be configured to actuate the locking mechanism 538 when the handle 550 is moved from the first handle position to the second handle position as shown in FIGS. 18-20. In one illustrative embodiment, the cable 552 can move the wedge 540 when the handle 550 is moved from the first handle position where the wedge 540 is in one of the recessed portions 544 to the second handle position where the wedge 540 does not engage the lateral members 534 and the slide 536 can move with respect to the lateral members 534. In another illustrative embodiment, the cable 552 can move the upper portion 640 of the slide 636 and the lower portion 642 of the slide 636 when the handle 550 is moved from the first handle position where the upper portion 640 and the lower portion 642 are closed together to act as a clamp and engage the lateral members 534 to the second handle position where the upper portion 640 and the lower portion 642 are moved apart to allow the slide 636 to move along the lateral members 534. It should be appreciated that only one of the upper portion 640 and the lower portion 642 can move with respect to the other.

Many other embodiments of the present disclosure are also envisioned. For example, a siderail assembly for a patient-support apparatus including a frame and defining a head end, a foot end longitudinally spaced-apart therefrom, and two laterally spaced-apart sides, comprises a siderail body and a movement assembly. The movement assembly is coupled to the siderail body and is configured to be coupled with the frame of the patient-support apparatus. The movement assembly is configured so that the siderail body moves relative to the frame about a generally laterally-extending axis between a lowered position, a first raised position, and a second raised position laterally spaced apart from the first raised position.

In another example, a siderail assembly for a patient-support apparatus including a frame and defining a head end, a foot end longitudinally spaced-apart therefrom, and two laterally spaced-apart sides extending therebetween, comprises a siderail body and a movement assembly. The movement assembly is coupled to the siderail body and to the frame. The movement assembly is configured to guide movement of the siderail body relative to the frame about a generally laterally-extending axis between a first lowered position and a first raised position, and between a second lowered position and a second raised position. The movement assembly includes a guide assembly having a follower and a guide. The follower is coupled with the siderail body for movement coordinated therewith. The guide is fixed relative to the frame. The follower engages the guide during at least a portion of the movement of the siderail body. The guide includes a first guide plate and a second guide plate. The first guide plate is configured to be removably coupled relative to the frame. The first guide plate includes a first track defining a first stop and a second stop. The follower engages the first stop when the siderail body is in the first raised position and the follower engages the second stop when the siderail body is in the first lowered position. The second guide plate is configured to be removably coupled to the bracket. The second guide plate includes a second track defining a third stop and a fourth stop. The follower engages the third stop when the siderail body is in the second raised position and the follower engages the fourth stop when the siderail body is in the second lowered position.

In another example, a guide assembly configured to guide the movement of a siderail of a patient-support apparatus having a frame comprises follower and a guide. The follower is coupled to the siderail and is configured to guide the movement of the siderail. The guide is fixed relative to the frame. The guide includes a guide plate having an edge defining a channel. The edge defines a first position, a second position, and a third position, and a first stop adjacent the first position, a second stop adjacent the second position, and a third stop adjacent the third position. A portion of the follower is received by the channel as the follower guides the movement of the siderail. The follower engages the first stop when the siderail is in a first position. The follower engages the second stop when the siderail is in a second position spaced apart from the first position. The follower engages the third stop when the siderail is in a third position spaced apart from each of the first and second positions. The edge defines a first channel portion between the first stop and the third stop and a second channel portion between the second stop and the third stop. The edge is configured so that at least a portion of the first channel portion is distinct from at least a portion of the second channel portion.

In another example, a patient-support apparatus includes a frame and a siderail coupled to the frame for movement relative thereto. The patient-support apparatus comprises a guide assembly. The guide assembly is coupled to the siderail and to the frame. The guide assembly includes a follower and a guide. The follower is coupled to the siderail for movement coordinated therewith between a first position, a second position spaced apart from the first position, and a third position spaced apart from each of the first position and the second position. The guide is fixed relative to the frame. The guide includes a first camming surface and a second camming surface. The first camming surface is engaged by the follower during at least a portion of the movement of the follower relative to the guide between the first position and the third position. The second camming surface is engaged by the follower during at least a portion of the movement of the follower relative to the guide between the second position and the third position. At least a portion of the second camming surface is distinct from at least a portion of the first camming surface.

In yet another example, a method for configuring the movement of a siderail body of a siderail assembly on a patient support apparatus including a frame comprises the steps of: determining the desired movement of the siderail body relative to the frame; selecting, from among a plurality of guide plates, a guide plate configured to cooperate with a follower of the siderail mechanism to permit the desired movement of the siderail body relative to the frame; and installing the selected guide plate in the siderail assembly.

In yet another example, a siderail assembly for a patient-support apparatus including a frame, the patient-support apparatus defining a head end, a foot end longitudinally spaced-apart therefrom, and two laterally spaced-apart sides extending therebetween, comprises a siderail body and a translation assembly. The translation assembly is coupled to the siderail body and to the frame. The translation assembly is configured to permit generally lateral translation of the siderail body relative to the frame between a first position and a second position spaced apart from the first position. The translation assembly includes a locking mechanism movable between a locking position blocking translation of the siderail body relative to the frame in at least one direction and a release position permitting translation of the siderail body relative to the frame in the at least one direction. The locking mechanism is configured to block the translation of the siderail body relative to the frame at any selected position between the first position and the second position.

In still another example, a patient-support apparatus defining a head end, a foot end longitudinally spaced-apart therefrom, and first and second laterally spaced-apart sides extending therebetween, comprises a frame, a first siderail body, and a second siderail body. The first siderail body is coupled to the first side of the frame by a first mounting assembly for movement relative to the frame about a generally laterally-extending axis between a lowered position, a first raised position, and a second raised position laterally spaced apart from the first raised position. The second siderail body is coupled to the second side of the frame by a second mounting assembly for movement relative to the frame about a generally laterally-extending axis between a lowered position, a first raised position, and a second raised position laterally spaced apart from the first raised position. The first siderail body is spaced apart from the second siderail body by a first distance when the first siderail body is in its first position and the second siderail body is in its first position and the first siderail body is spaced apart from the second siderail body by a second distance greater than the first distance when the first siderail body is in its second position and the second siderail body is in its second position.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless can not be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles can have been presented, they need not be utilized in combination, and various combinations of inventive aspects and principles are possible in light of the various embodiments provided above.

What is claimed is:

1. A siderail assembly for a patient-support apparatus including a frame, the patient-support apparatus defining a head end, a foot end longitudinally spaced-apart therefrom, and two laterally spaced-apart sides, the siderail assembly comprising a siderail body, and a movement assembly coupled to the siderail body and configured to be coupled with the frame of the patient-support apparatus, the movement assembly configured so that the siderail body moves relative to the frame about a generally laterally-extending axis between a storage position, a first deployed position, and a second deployed position laterally spaced apart from the first deployed position, wherein the first deployed position and the second deployed position are at about the same vertical height.

2. The siderail assembly of claim 1, wherein the movement assembly includes a bracket coupleable with the frame, an arm coupled to the siderail body for rotation relative to the siderail body about a first pivot axis and engaged with the bracket for translation in a direction generally parallel to the first pivot axis and for rotation relative to the bracket about a second pivot axis laterally spaced apart from first pivot axis, and a guide assembly configured to guide movement of the arm relative to the bracket.

3. The siderail assembly of claim 2, wherein the guide assembly includes a follower fixed relative to bracket, and a guide fixed relative to the arm, the follower engaging the guide.

4. The siderail assembly of claim 2, wherein the guide assembly includes a follower fixed relative to the arm and a guide fixed relative to the bracket, the follower engaging the guide.

5. The siderail assembly of claim 4, wherein the guide comprises a path including a first portion configured to cooperate with the follower to move the siderail body toward the first deployed position, a second portion configured to cooperate with the follower to move the siderail body toward the second deployed position, and a third portion connected to the first portion and the second portion and configured to cooperate with the follower to move the siderail body toward the storage position.

6. The siderail assembly of claim 5, wherein the first portion of the path terminates at a first end, the second portion of the path terminates at a second end, and the third portion of the path terminates at a third end, and the follower engages the first end when the siderail body is in the first deployed position, the follower engages the second end when the siderail body is in the second deployed position, and the follower engages the third end when the siderail body is in the storage position.

7. The siderail assembly of claim 5, wherein the first portion, second portion, and third portion of the path are defined by slots selected from the group of slots consisting of a curved slot or a linear slot.

8. The siderail assembly of claim 6, wherein the siderail body moves between the storage position and the first deployed position as the follower moves along the third portion and the first portion of the path between the third end and the first end.

9. The siderail assembly of claim 6, wherein the siderail body moves between the storage position and the second deployed position as the follower moves along the third portion and the second portion of the path between the third end and the second end.

10. The siderail assembly of claim 2, wherein a portion of the guide assembly is removably coupled to the bracket.

11. The siderail assembly of claim 2, wherein a portion of the guide assembly is removably coupled to the bracket parallel to the second pivot axis.

12. The siderail assembly of claim 1, wherein the movement assembly is configured to permit revolution of the siderail body relative to the frame about the generally laterally-extending axis and to permit generally lateral translation of the siderail body relative to the frame.

13. The siderail assembly of claim 12, further comprising a lateral latch system configured to selectively prevent translation of the siderail body relative to the frame in at least one direction.

14. The siderail assembly of claim 13, wherein the lateral latch system includes an actuation mechanism mounted to the siderail body.

15. The siderail assembly of claim 13, wherein the lateral latch system includes a locking mechanism configured to be moved between a first position where a stopper is configured to prevent translation of the siderail body relative to the frame in at least one direction and a second position where the stopper is configured to allow the siderail body to translate relative to the frame.

16. The siderail assembly of claim 13, wherein the lateral latch system includes a latch receiver fixed laterally relative to the frame, a slide fixed laterally relative to the siderail body and mounted for movement relative to the latch receiver, and a locking mechanism movable between a locking position blocking movement of the slide relative to the latch receiver and a release position permitting movement of the slide relative to the latch receiver.

17. The siderail assembly of claim 16, wherein the latch receiver is shaped as a notch and the locking mechanism is received by the latch receiver when the locking mechanism is in the locking position.

18. The siderail assembly of claim 16, wherein the locking mechanism encircles at least a portion of a lateral member and engages the lateral member when the locking mechanism is in the locking position.

19. The siderail assembly of claim 12, wherein the movement assembly is further configured so that the siderail body moves relative to the frame about the generally laterally-extending axis between the storage position and a second storage position, wherein the storage position and the second storage position are at about the same vertical height.

20. A siderail assembly for a patient-support apparatus including a frame, the patient-support apparatus defining a head end, a foot end longitudinally spaced-apart therefrom, and two laterally spaced-apart sides extending therebetween, the siderail assembly comprising a siderail body, and a movement assembly coupled to the siderail body and to the frame, the movement assembly configured to guide movement of the siderail body relative to the frame about a generally laterally-extending axis between at least one storage position and at least one deployed position, the movement assembly including a bracket a guide assembly including a follower coupled with the siderail body for movement coordinated therewith and a guide configured to be removably coupled relative to the bracket, the guide including a path defined by a first slot terminating at a first end and a second end and a second slot connected to the first slot at a first end and terminating at a second end, the follower engaging the first end of the first slot when the siderail body is in a first position and the follower engaging the second end of the first slot when the siderail body is in a second position and the follower being positioned at about the first end of the second slot when the siderail body is in a third position and the follower engaging the second end of the second slot when the siderail body is in a fourth position, wherein the siderail body in the second position and the fourth position are at about the same vertical height with respect to a reference point.

21. The siderail assembly of claim 20, wherein the first position is laterally spaced apart from the third position.

22. The siderail assembly of claim 20, wherein the second position is laterally spaced apart from the fourth position.

23. The siderail assembly of claim 20, wherein the path is further defined by a third slot connected to the first slot at a first end and terminating at a second end, the follower being positioned at about the first end of the third slot when the siderail body is in a fifth position and the follower engaging the second end of the third slot when the siderail body is in a sixth position, wherein the siderail body in the second position and the sixth position are at about the same vertical height with respect to a reference point.

24. The siderail assembly of claim 20, wherein the path is further defined by a fourth slot connected to the first slot at a first end and terminating at a second end, the follower being positioned at about the first end of the fourth slot when the siderail body is in a seventh position and the follower engaging the second end of the fourth slot when the siderail body is in an eighth position, wherein the siderail body in the second position and the eighth position are at about the same vertical height with respect to a reference point.

25. A guide assembly configured to guide the movement of a siderail of a patient-support apparatus having a frame, the guide assembly comprising:

a follower coupled to the siderail and configured to move therewith; and a guide fixed relative to the frame, the guide including a path comprising a first portion of the path configured to cooperate with the follower to move the siderail toward a first deployed position, a second portion of the path configured to cooperate with the follower to move the siderail toward a second deployed position, and a third portion of the path configured to cooperate with the follower to move the siderail toward a storage position, wherein the siderail is in the first deployed position when the follower engages an end of the first portion of the path, in the second deployed position when the follower engages an end of the second portion of the path, and in the storage position when the follower engages an end of the third portion of the path, and wherein the second deployed position is laterally spaced apart from the first deployed position and at substantially the same vertical height with respect to a reference point.

26. A patient-support apparatus including a frame and a siderail coupled to the frame for movement relative thereto, the patient-support apparatus comprising:

a guide assembly coupled to the siderail and to the frame, the guide assembly including a follower coupled to the siderail for movement coordinated therewith between a first position, a second position spaced apart from the first position a first distance, and a third position spaced apart from each of the first position and the second position, wherein the siderail being at substantially the same vertical height with respect to the frame when the siderail is in the second position and the third position and laterally spaced apart from the frame a first distance in the second position and a second distance in the third position, a guide including a first guide path engaged by the follower during at least a portion of the movement of the follower relative to the guide path between the first position and the third position, and a second guide path engaged by the follower during at least a portion of the movement of the follower relative to the guide path between the second position and the third position, at least a portion of the second guide path being distinct from at least a portion of the first guide path, wherein the second guide path is spaced apart from the first guide path by a third distance and wherein the distance between the first guide path and the second guide path is substantially equal to the distance between the siderail in the second position and the siderail in the third position.

27. A patient-support apparatus, the patient support apparatus comprising:

a frame including a head end, a foot end longitudinally spaced-apart from the head end, and a first side and a second side laterally spaced-apart from the first side, the first side and the second side extending between the head end and the foot end, a first siderail body coupled to the first side of the frame for movement relative to the frame about a first generally laterally-extending axis between a storage position, a first deployed position, and a second deployed position laterally spaced apart from the first deployed position, and a second siderail body coupled to the second side of the frame for movement relative to the frame about a second generally laterally-extending axis between a storage position, a first deployed position, and a second deployed position laterally spaced apart from the first deployed position, the first siderail body laterally spaced apart from the second siderail body by a first distance when the first siderail body is in its first deployed position and the second siderail body is in its first deployed position and the first siderail body is laterally spaced apart from the second siderail body by a second distance greater than the first distance when the first siderail body is in its second deployed position and the second siderail body is in its second deployed position, wherein the first siderail body and the second siderail body are at substantially the same vertical height with respect to a reference point when the first siderail body and the second siderail body are in at least one of the first deployed position and the second deployed position.

28. The patient-support apparatus of claim 27, further comprising a third siderail body coupled to the first side of the frame for movement relative to the frame about a third generally laterally-extending axis between a storage position, a first deployed position, and a second deployed position laterally spaced apart from the first deployed position, and a fourth siderail body coupled to the second side of the frame for movement relative to the frame about a fourth generally laterally-extending axis between a storage position, a first deployed position, and a second deployed position laterally spaced apart from the first deployed position, the third siderail body laterally spaced apart from the fourth siderail body by a third distance when the third siderail body is in its first deployed position and the fourth siderail body is in its first deployed position and the third siderail body laterally spaced apart from the fourth siderail body by a fourth distance greater than the third distance when the third siderail body is in its second deployed position and the fourth siderail body is in its second deployed position.

29. The patient support apparatus of claim 28, wherein the first distance is substantially equal to the third distance and the second distance is substantially equal to the fourth distance.

* * * * *